US008967332B2

(12) United States Patent
Wolner

(10) Patent No.: US 8,967,332 B2
(45) Date of Patent: Mar. 3, 2015

(54) SAFETY HARNESS STRAP ADJUSTER

(75) Inventor: J. Thomas Wolner, Red Wing, MN (US)

(73) Assignee: D B Industries, LLC, Red Wing, MN (US)

( * ) Notice: Subject to any disclaimer, the term of this patent is extended or adjusted under 35 U.S.C. 154(b) by 1130 days.

(21) Appl. No.: 12/415,412

(22) Filed: Mar. 31, 2009

(65) Prior Publication Data

US 2010/0242232 A1 Sep. 30, 2010

(51) Int. Cl.
*A44B 11/00* (2006.01)
*A62B 35/00* (2006.01)

(52) U.S. Cl.
CPC ..... *A62B 35/0031* (2013.01)
USPC ..... 182/3; 24/68 R; 24/164; 254/222

(58) Field of Classification Search
USPC ..... 24/68 CD, 71.1, 68 D, 68 R, 68 E, 164, 24/166, 167, 182, 170; 182/3, 6, 7; 242/378.1, 382, 384.7, 388.1, 388.2, 242/388.3; 254/222, 223
See application file for complete search history.

(56) References Cited

U.S. PATENT DOCUMENTS

| | | | | |
|---|---|---|---|---|
| 604,302 | A | 5/1898 | Clark | |
| 3,424,134 | A * | 1/1969 | Rosenblum | 182/3 |
| 3,749,366 | A | 7/1973 | Brucker | |
| 3,757,744 | A | 9/1973 | Pravaz | |
| 3,775,813 | A * | 12/1973 | Higuchi | 24/323 |
| 3,988,007 | A * | 10/1976 | Freiburger, Jr. | 24/68 R |
| 4,264,251 | A | 4/1981 | Blatt | |
| 4,302,049 | A | 11/1981 | Simpson | |
| 4,553,633 | A | 11/1985 | Armstrong et al. | |
| 4,604,773 | A | 8/1986 | Weber et al. | |
| 4,786,223 | A | 11/1988 | Crissy et al. | |
| 4,799,297 | A | 1/1989 | Baggio et al. | |
| 5,156,506 | A | 10/1992 | Bailey | |
| 5,203,829 | A | 4/1993 | Fisk et al. | |
| 5,277,348 | A | 1/1994 | Reid | |
| 5,649,341 | A | 7/1997 | Ashline et al. | |
| 6,230,370 | B1 * | 5/2001 | Nelsen | 24/68 CD |
| 6,322,279 | B1 * | 11/2001 | Yamamoto et al. | 403/97 |

(Continued)

FOREIGN PATENT DOCUMENTS

| | | | |
|---|---|---|---|
| DE | 3401978 | A1 | 8/1985 |
| DE | 20 2004 017 043 | U1 | 12/2004 |
| DE | 20 2007 004 649 | U1 | 6/2007 |

OTHER PUBLICATIONS

DBI SALA, User Instruction Manual Full Body Harness, Form: 5908231, Rev: M. DB Industries, Inc. 2009.

(Continued)

*Primary Examiner* — Daniel Cahn
(74) *Attorney, Agent, or Firm* — IPLM Group, P.A.

(57) ABSTRACT

An adjuster adjusts a length of at least one strap of a safety harness. The at least one strap is selected from the group consisting of at least one shoulder strap, at least one chest strap, at least one waist strap, at least one seat strap, and at least one leg strap. The adjuster comprises a base, a shaft rotatably operatively connected to the shaft and defining a slot configured and arranged to receive the at least one strap, and a locking mechanism interconnecting the base and the shaft. The locking mechanism allows rotation of the shaft in a first direction and prevents rotation of the shaft in a second opposite direction.

12 Claims, 25 Drawing Sheets

(56) References Cited

U.S. PATENT DOCUMENTS

| | | | | |
|---|---|---|---|---|
| 6,405,685 | B1 | 6/2002 | Cox | |
| 6,457,701 | B1 | 10/2002 | Huang | |
| 6,484,372 | B2 | 11/2002 | Novak et al. | |
| 6,641,116 | B1 | 11/2003 | Huang | |
| 6,668,434 | B2 | 12/2003 | Casebolt et al. | |
| 6,799,750 | B2 * | 10/2004 | Chen | 254/218 |
| 6,824,121 | B2 | 11/2004 | Boice | |
| 7,025,171 | B2 | 4/2006 | Cox | |
| 7,036,628 | B2 * | 5/2006 | Wilcox et al. | 182/9 |
| 7,069,623 | B2 | 7/2006 | Lu | |
| 7,373,701 | B2 | 5/2008 | Coulombe et al. | |
| 7,513,018 | B2 | 4/2009 | Koenig et al. | |
| 7,712,192 | B2 | 5/2010 | Lin et al. | |
| 2006/0005293 | A1 | 1/2006 | Frey et al. | |
| 2006/0081824 | A1 | 4/2006 | Ruan | |
| 2006/0102423 | A1 | 5/2006 | Lang et al. | |
| 2006/0131457 | A1 | 6/2006 | Nohren et al. | |
| 2008/0060873 | A1 | 3/2008 | Lang et al. | |
| 2008/0189921 | A1 * | 8/2008 | Tomosue | 24/68 R |
| 2010/0243373 | A1 | 9/2010 | Johnson et al. | |
| 2011/0302688 | A1 | 12/2011 | Vieux | |

OTHER PUBLICATIONS

U.S. Appl. No. 12/414,364.

International Search Report from International Application Serial No. PCT/US2010/028616 mailed Sep. 6, 2010.

Notice of Allowance (PTO-892) Notice of References Cited. U.S. Appl. No. 12/415,450, mailed May 21, 2014.

* cited by examiner

FIG. 1
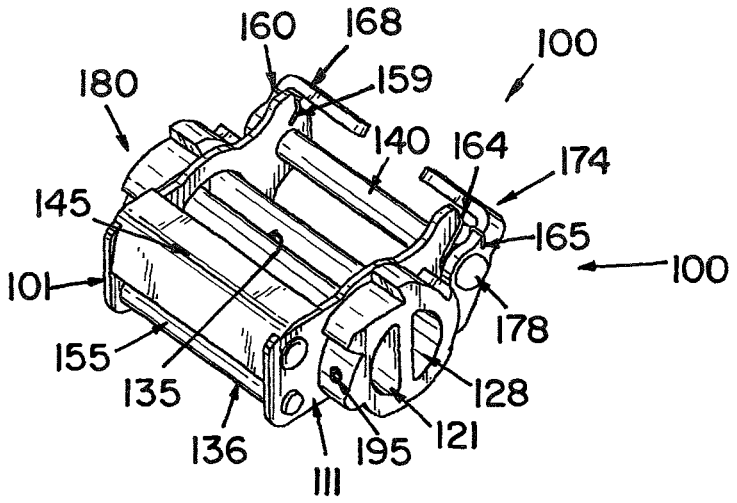
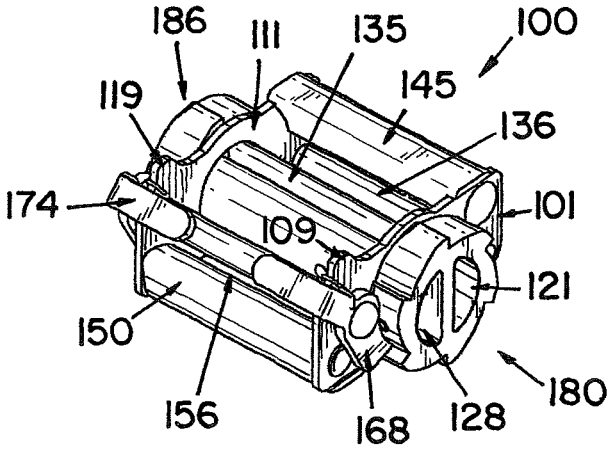
FIG. 2

FIG. 26
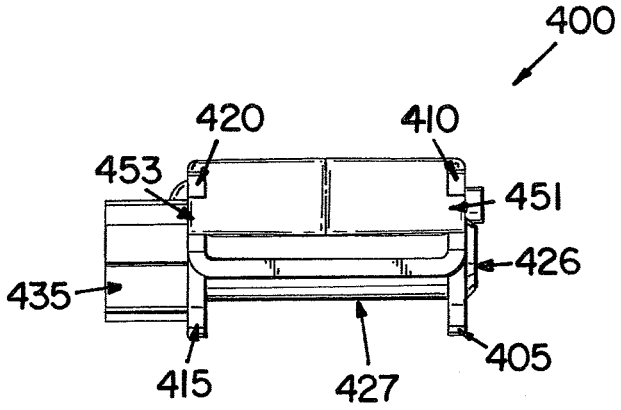
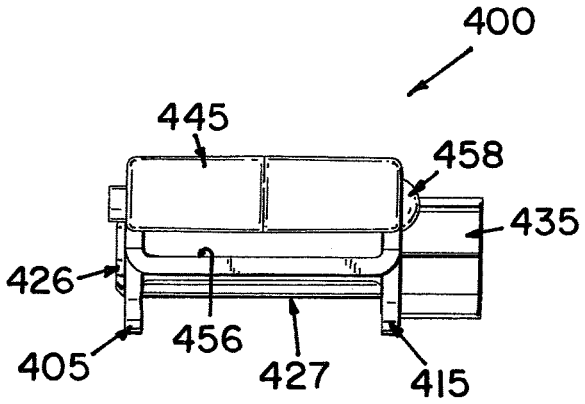
FIG. 27

FIG. 28
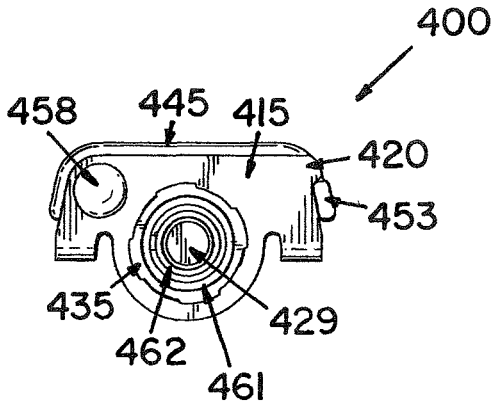
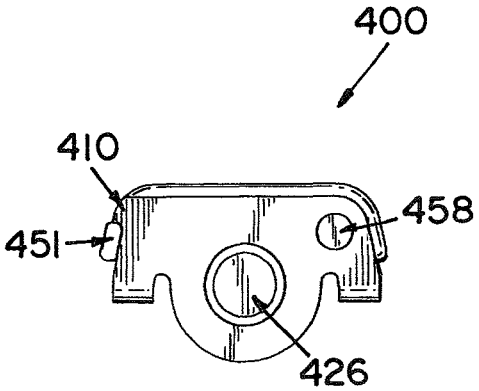
FIG. 29

FIG. 39
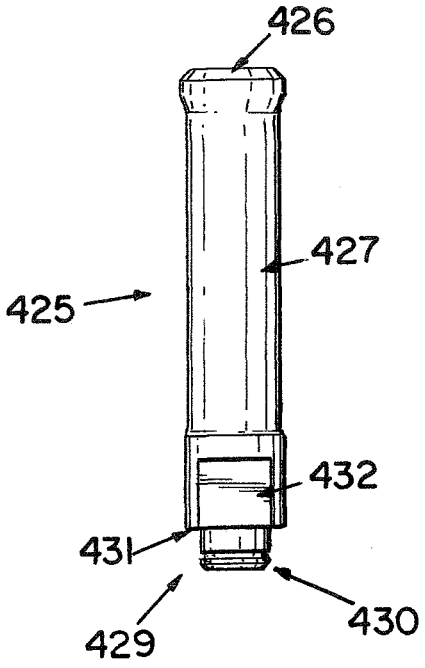
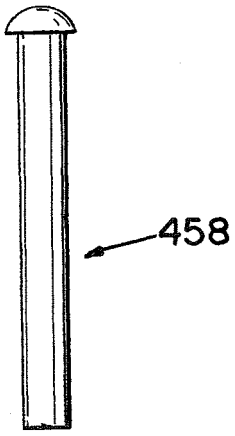
FIG. 38

FIG.49
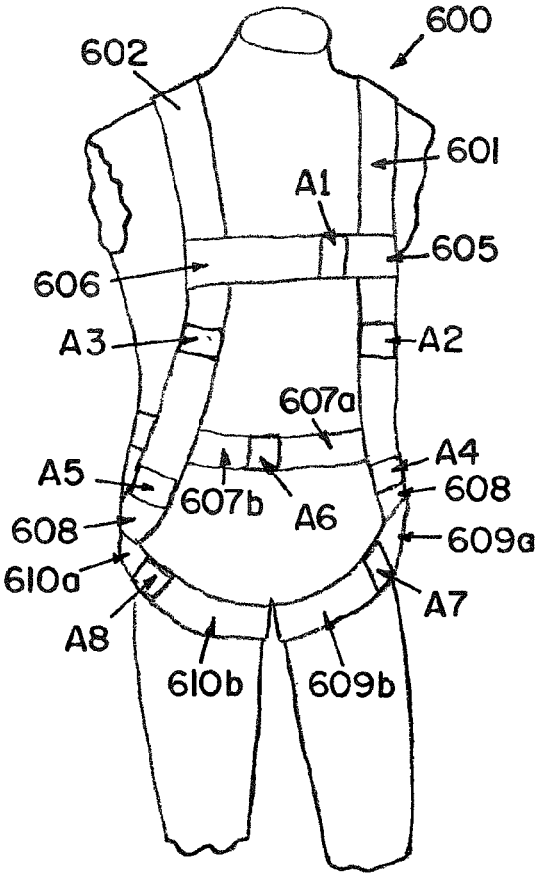
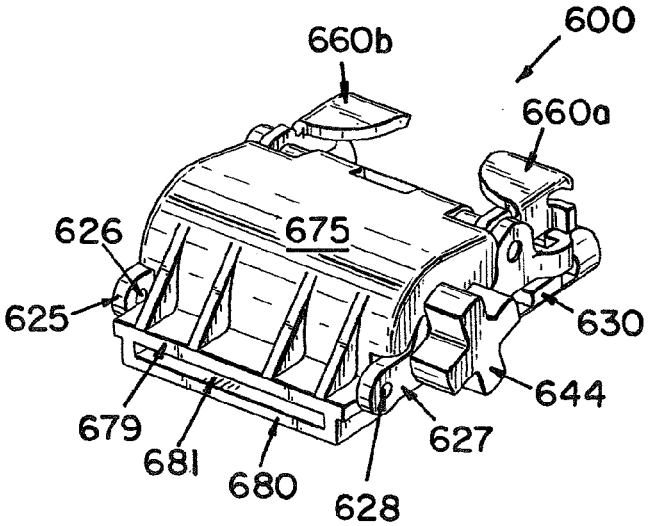
FIG.50

SAFETY HARNESS STRAP ADJUSTER

FIELD OF THE INVENTION

The present invention relates to a safety harness strap adjuster.

BACKGROUND

Various occupations place people in precarious positions at relatively dangerous heights thereby creating a need for fall-arresting safety apparatus. Among other things, such apparatus usually include a safety line interconnected between a support structure and a person working in proximity to the support structure. The safety line is typically secured to a full-body safety harness worn by the worker. Obviously, such a harness must be designed to remain secure about the worker in the event of a fall. In addition, the harness should arrest a person's fall in as safe a manner as possible, placing a minimal amount of strain on the person's body. Yet another design consideration is to minimize the extent to which people may consider the harness uncomfortable and/or cumbersome.

Various types of buckles are used to interconnect straps of harnesses. One problem with some of these buckles is that the straps could loosen and compromise the proper fit of the harness, and proper fit is important to maximize safety and minimize injury.

For the reasons stated above and for other reasons stated below, which will become apparent to those skilled in the art upon reading and understanding the present specification, there is a need in the art for a safety harness strap adjuster.

SUMMARY

The above-mentioned problems associated with prior devices are addressed by embodiments of the present invention and will be understood by reading and understanding the present specification. The following summary is made by way of example and not by way of limitation. It is merely provided to aid the reader in understanding some of the aspects of the invention.

One embodiment adjuster for adjusting a length of at least one strap of a safety harness comprises a base, a shaft rotatably operatively connected to the shaft and defining a slot configured and arranged to receive the at least one strap, and a locking mechanism interconnecting the base and the shaft. The locking mechanism allows rotation of the shaft in a first direction and prevents rotation of the shaft in a second opposite direction. The at least one strap is selected from the group consisting of at least one shoulder strap, at least one chest strap, at least one waist strap, at least one seat strap, and at least one leg strap.

One embodiment adjuster for adjusting a length of at least one strap of a safety harness, comprises a base, a shaft rotatably operatively connected to the shaft and defining a slot configured and arranged to receive the at least one strap, and a locking mechanism interconnecting the base and the shaft. The locking mechanism allows rotation of the shaft in a first direction and prevents rotation of the shaft in a second opposite direction. The locking mechanism comprises a ratchet wheel with teeth operatively connected to each end of the shaft, pawls pivotally connected to the base and configured and arranged to engage the ratchet wheels in an engaged position and disengage the ratchet wheels in a disengaged position, and springs interconnecting the pawls and the base to bias the pawls in the engaged position. The shaft is rotatable in the first direction when the pawls are in the engaged position, and the shaft is rotatable in the first direction and in the second direction when both of the pawls are positioned in the disengaged position. The at least one strap is selected from the group consisting of at least one shoulder strap, at least one chest strap, at least one waist strap, at least one seat strap, and at least one leg strap.

One embodiment adjuster for adjusting a length of at least one strap of a safety harness comprises a base, a shaft rotatably operatively connected to the shaft and defining a slot configured and arranged to receive the at least one strap, and a locking mechanism interconnecting the base and the shaft. The locking mechanism allows rotation of the shaft in a first direction and prevents rotation of the shaft in a second opposite direction. The locking mechanism comprises a knob operatively connected to an end of the shaft, a spring operatively connected to the end of the shaft and to the knob to bias the knob toward the base, one of the base and the knob having an inclined ramp, and another of the base and the knob having a notch, wherein the notch receives the ramp in an engaged position. The shaft is rotatable in the first direction when the ramp is positioned in the notch in an engaged position, and the shaft is rotatable in the first direction and in the second direction when the knob is moved away from the base to release the ramp from the notch in a disengaged position. The at least one strap is selected from the group consisting of at least one shoulder strap, at least one chest strap, at least one waist strap, at least one seat strap, and at least one leg strap.

BRIEF DESCRIPTION OF THE DRAWINGS

The present invention can be more easily understood, and further advantages and uses thereof can be more readily apparent, when considered in view of the detailed description and the following Figures in which:

FIG. 1 is a bottom front perspective view of an embodiment adjuster constructed in accordance with the principles of the present invention;

FIG. 2 is a top front perspective view of the adjuster shown in FIG. 1;

FIG. 26 is a top view of the adjuster shown in FIG. 24;

FIG. 27 is a bottom view of the adjuster shown in FIG. 24;

FIG. 28 is a side view of the adjuster shown in FIG. 24;

FIG. 29 is a side view of the adjuster shown in FIG. 24;

FIG. 38 is a front view of a fastener of the adjuster shown in FIG. 24;

FIG. 39 is a bottom view of a shaft of the adjuster shown in FIG. 24;

FIG. 49 is a perspective schematic view of another safety harness with adjusters;

FIG. 50 is a rear perspective view of another embodiment adjuster constructed in accordance with the principles of the present invention;

In accordance with common practice, the various described features are not drawn to scale but are drawn to emphasize specific features relevant to the present invention. Reference characters denote like elements throughout the Figures and the text.

DETAILED DESCRIPTION OF A PREFERRED EMBODIMENT

Figure 3:
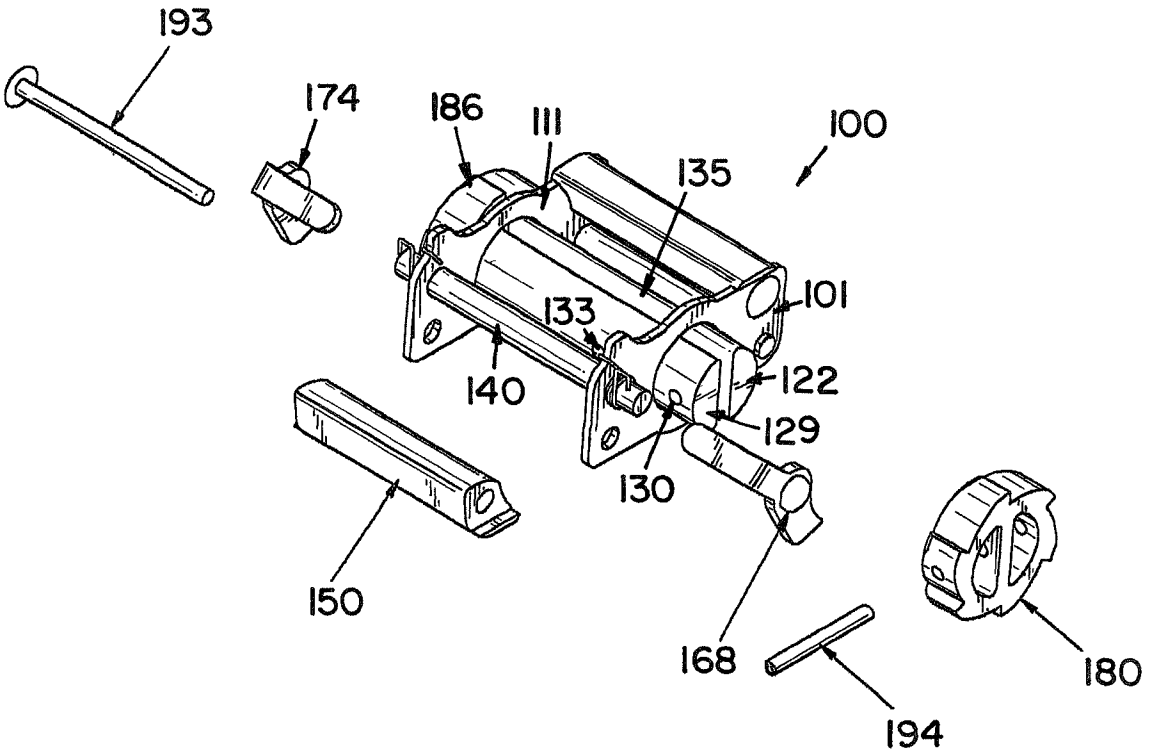
FIG. 3 is a partial exploded top front perspective view of the adjuster shown in FIG. 1.
Figure 4:
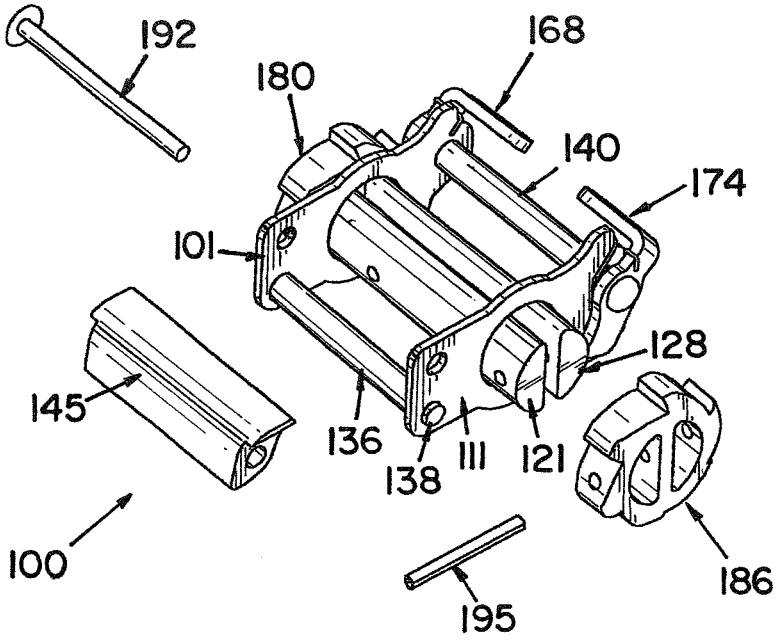
FIG. 4 is a partial exploded bottom front perspective view of the adjuster shown in FIG. 1.
Figure 5:
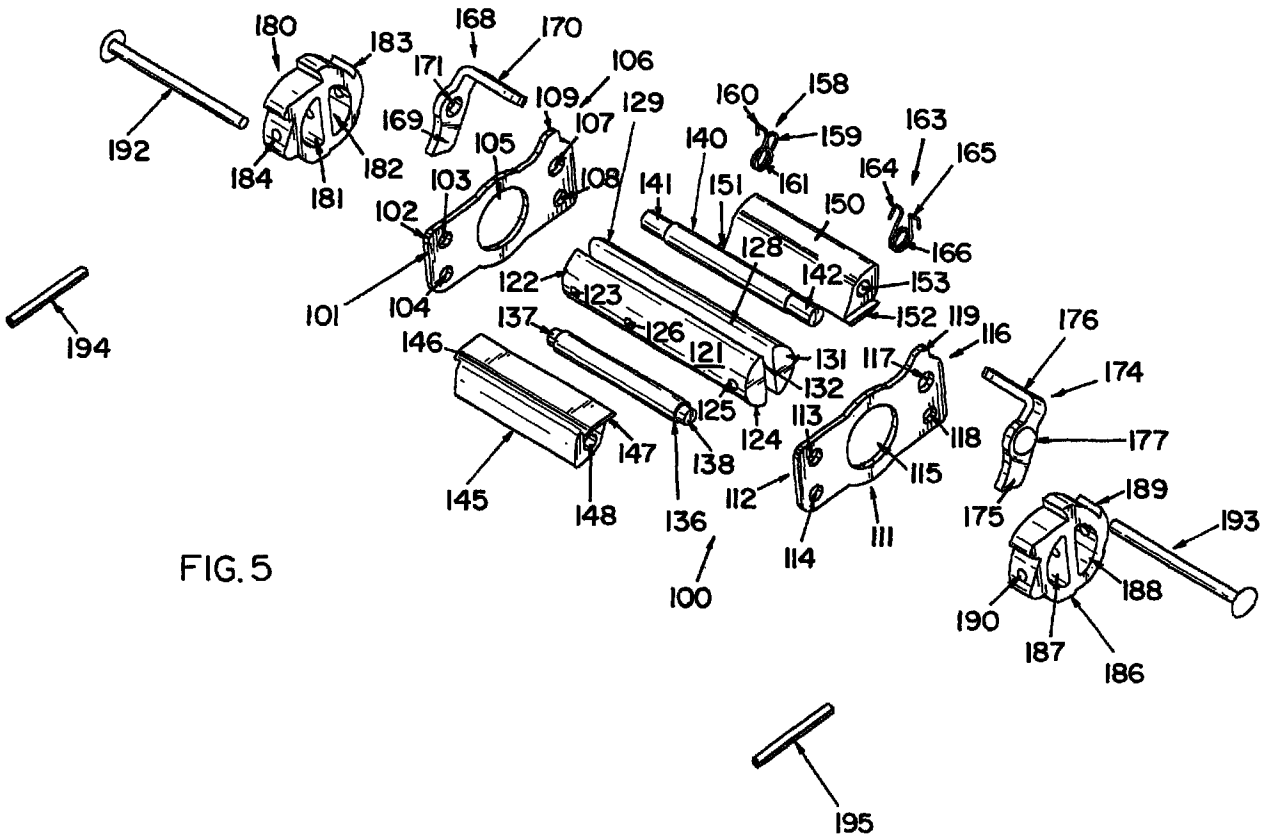
FIG. 5 is an exploded bottom front perspective view of the adjuster shown in FIG. 1.

In the following detailed description, reference is made to the accompanying drawings, which form a part hereof, and in which is shown by way of illustration embodiments in which the inventions may be practiced. These embodiments are described in sufficient detail to enable those skilled in the art to practice the invention, and it is to be understood that other embodiments may be utilized and mechanical changes may be made without departing from the spirit and scope of the present invention. The following detailed description is, therefore, not to be taken in a limiting sense, and the scope of the present invention is defined only by the claims and equivalents thereof.

Embodiments of adjusters constructed in accordance with the principles of the present invention are designated by the numerals 100, 200, 300, 400, 400', and 600 in the drawings.

An embodiment adjuster 100 is shown in FIGS. 1-11. Although the adjuster is being described in the orientation shown in FIG. 5, it should be understood that the adjuster should not be limited to this orientation. The adjuster 100 includes base plates 101 and 111 to which other components are operatively connected.

The base plate 101 is generally rectangular and includes a first side 102 proximate the front and a second side 106 proximate the rear. The base plate 101 includes an aperture 103 proximate the top and the first side 102 and an aperture 104 proximate the bottom and the first side 102. The base plate 101 includes an aperture 107 proximate the top and the second side 106 and an aperture 108 proximate the bottom and the second side 106. The base plate 101 also includes a center aperture 105 proximate the center of the base plate 101 between the apertures 103 and 104 and the apertures 107 and 108. Proximate the aperture 107 and the top, a protrusion 109 extends generally upwardly from the base plate 101 and forms a notch proximate the top and the second side 106.

The base plate 111 is also generally rectangular and includes a first side 112 proximate the front and a second side 116 proximate the rear. The base plate 111 includes an aperture 113 proximate the top and the first side 112 and an aperture 114 proximate the bottom and the first side 112. The base plate 111 includes an aperture 117 proximate the top and the second side 116 and an aperture 118 proximate the bottom and the second side 116. The base plate 111 also includes a center aperture 115 proximate the center of the base plate 111 between the apertures 113 and 114 and the apertures 117 and 118. Proximate the aperture 117 and the top, a protrusion 119 extends generally upwardly from the base plate 111 and forms a notch proximate the top and the second side 116.

A hub or shaft includes hub portions 121 and 128, which are operatively connected to the base plates 101 and 111. The hub portions 121 and 128 are shafts having semicircular cross-sections and are positioned with the flat portions facing one another with a gap forming a slot 135 therebetween. The hub portion 121 includes a first end 122 with a bore 123 extending laterally therethrough, a second end 124 with a bore 125 extending laterally therethrough, and a bore 126 extending laterally through an intermediate portion between the first and second ends 122 and 124. The hub portion 128 includes a first end 129 with a bore 130 extending laterally therethrough, a second end 131 with a bore 132 extending laterally therethrough, and a bore 133 extending laterally through an intermediate portion between the first and second ends 129 and 131.

A pin 136 is a cylindrical shaft with first and second ends 137 and 138 having smaller diameters than an intermediate portion of the pin 136. The first end 137 is configured and arranged to be inserted into the aperture 104 of the base plate 101, and the second end 138 is configured and arranged to be inserted into the aperture 114 of the base plate 111. The intermediate portion of the pin 136 is positioned between the base plates 101 and 111.

A pin 140 is also a cylindrical shaft with first and second ends 141 and 142 having smaller diameters than an intermediate portion of the pin 140. The first end 141 is configured and arranged to be inserted through the aperture 107 of the base plate 101, and the second end 142 is configured and arranged to be inserted through the aperture 117 of the base plate 111. The ends 141 and 142 extend outward from the respective outer sides of the base plates 101 and 111, and the intermediate portion of the pin 140 is positioned between the base plates 101 and 111.

A ratchet wheel 180 is a generally cylindrical portion with first and second semicircular longitudinal bores 181 and 182 configured and arranged to receive the ends 122 and 129 of the hub portions 121 and 128. The ratchet wheel 180 also includes teeth 183 extending outward from its sides and a lateral bore 184. The lateral bore 184 corresponds with the bores 123 and 130 of the hub portions 121 and 128, and a fastener 194 extends through the bores to connect the ratchet wheel 180 to the ends 122 and 129.

A ratchet wheel 186 is also a generally cylindrical portion with first and second longitudinal bores 187 and 188 configured and arranged to receive the ends 124 and 131 of the hub portions 121 and 128. The ratchet wheel 186 also includes teeth 189 extending outward from its sides and a lateral bore 190. The lateral bore 190 corresponds with the bores 125 and 132 of the hub portions 121 and 128, and a fastener 195 extends through the bores to connect the ratchet wheel 186 to the ends 124 and 131.

A spacer 145 is a generally square-shaped shaft from which a first flange 146 extends outward from proximate the top of one end and a second flange 147 extends outward from proximate the top of the other end. A bore 148 extends longitudinally through the spacer 145. The base of the spacer 145 is configured and arranged to be positioned between the base plates 101 and 111 so that the bore 148 corresponds with the apertures 103 and 113 of the base plates 101 and 111, and the flanges 146 and 147 are positioned on top of the base plates 101 and 111. A fastener 192 extends through the apertures 103 and 113 and the bore 148 to connect the spacer 145 to the base plates 101 and 111. The pin 136 and the spacer 145 form a slot 155 therebetween.

A spacer 150 is also a generally square-shaped shaft from which a first flange 151 extends outward from proximate the bottom of one end and a second flange 152 extends outward from proximate the bottom of the other end. A bore 153 extends longitudinally through the spacer 150. The base of the spacer 150 is configured and arranged to be positioned between the base plates 101 and 111 so that the bore 153 corresponds with the apertures 108 and 118 of the base plates 101 and 111, and the flanges 151 and 152 are positioned below the base plates 101 and 111. A fastener 193 extends through the apertures 108 and 118 and the bore 153 to connect the spacer 150 to the base plates 101 and 111. The pin 140 and the spacer 150 form a slot 156 therebetween.

A pawl member 168 is generally L-shaped with an engaging portion 169 proximate one end and a release portion 170 proximate the other end. The engaging portion 169 includes an aperture 171 proximate the juncture of the two ends. The first end 141 of the pin 140 extends through the aperture 171, and the first end 141 is clinched to form a head, which secures the pawl member 168 to the pin 140. The engaging portion 169 is configured and arranged to engage a tooth of the ratchet wheel 180.

A pawl member 174 is also generally L-shaped with an engaging portion 175 proximate one end and a release portion 176 proximate the other end. The engaging portion 175 includes an aperture (not shown) proximate the juncture of the two ends. The second end 142 of the pin 140 extends through the aperture 177, and the second end 142 is clinched to form a head, which secures the pawl member 174 to the pin 140. The engaging portion 175 is configured and arranged to engage a tooth of the ratchet wheel 186.

A spring 158 includes a coiled intermediate portion 161 interconnecting a first end 159 and a second end 160, and a spring 163 includes a coiled intermediate portion 166 interconnecting a first end 164 and a second end 165. The coiled portion 161 of the spring 158 is configured and arranged to be positioned about the first end 141 of the pin 140, and the coiled portion 166 of the spring 163 is configured and arranged to be positioned about the second end 142 of the pin 140. The spring 158 is positioned between the base plate 101 and the pawl member 168, and the spring 163 is positioned between the base plate 111 and the pawl member 174. The first end 159 of the spring 158 engages the base plate 101 proximate the notch formed by the protrusion 109, and the second end 160 of the spring 158 engages the pawl member 168. Because the pawl member 168 is pivotally connected to the pin 140, the spring 158 places a biasing force on the pawl member 168 so that the engaging portion 169 is biased in a downward direction to engage the ratchet wheel 180. The first end 164 of the spring 163 engages the base plate 111 proximate the notch formed by the protrusion 119, and the second end 165 of the spring 163 engages the pawl member 174. Because the pawl member 174 is pivotally connected to the pin 140, the spring 163 places a biasing force on the pawl member 174 so that the engaging portion 175 is biased in a downward direction to engage the ratchet wheel 186.

To assemble the adjuster 100 and connect the adjuster to a strap or webbing 197 of a safety harness, the hub portions 121 and 128 are positioned on opposing sides of the webbing 197 with the flat portions facing one another thus positioning the webbing 197 in the slot 135. The ends 122 and 129 of the hub portions 121 and 128 are inserted through the center aperture 105 of the base plate 101 and into the respective bores 181 and 182 of the ratchet wheel 180, and the fastener 194 is inserted into the bores 184, 123, and 130. The ends 137 and 141 of the pins 136 and 140 are inserted into the respective apertures 104 and 107 of the base plate 101, and then the base plate 111 is connected. The pins 136 and 140 are positioned on opposing sides of the webbing 197. The ends 124 and 131 of the hub portions 121 and 128 are inserted through the center aperture 115 and the ends 138 and 142 of the pins 136 and 140 are inserted into the respective apertures 114 and 117 of the base plate 111. The ends 124 and 131 of the hub portions 121 and 128 are then inserted into the respective bores 187 and 188 of the ratchet wheel 186, and the fastener 195 is inserted into the bores 190, 125, and 132. A fastener could be inserted through the bores 126 and 133 and the webbing to secure the webbing to the hub portions 121 and 128, if desired. The spacers 145 and 150 are positioned between the base plates 101 and 111 so that the bores 148 and 153 correspond with the respective apertures 103 and 113 and apertures 108 and 118, the flanges 146 and 147 being proximate the top of the base plates 101 and 111 and the flanges 151 and 152 being proximate the bottom of the base plates 101 and 111, and then fasteners 192 and 193 are inserted to connect the spacers 145 and 150 to the base plates 101 and 111. The spacers 145 and 150 are positioned on opposing sides of the webbing 197, and the webbing 197 extends through the opening 155 formed by the pin 136 and the spacer 145 and the opening 156 formed by the pin 140 and the spacer 150.

The coiled portion 161 of the spring 158 is positioned about the first end 141 of the pin 140 extending outward from the base plate 101, and the first end 159 of the spring is positioned to engage the base plate 101 proximate the notch formed by the protrusion 109. The first end 141 is then inserted into the aperture 171 of the pawl member 168, with the engaging portion 169 positioned to engage a tooth of the ratchet wheel 180, the second end 160 of the spring is positioned to engage the pawl member 168, and a fastener (not shown) is inserted through the aperture 171 and into the first end 141 to secure the pawl member 168 to the pin 140. The coiled portion 166 of the spring 163 is positioned about the second end 142 of the pin 140 extending outward from the base plate 111, and the first end 164 of the spring is positioned to engage the base plate 111 proximate the notch formed by the protrusion 119. The second end 142 is then inserted into the aperture (not shown) of the pawl member 174, with the engaging portion 175 positioned to engage a tooth of the ratchet wheel 186, the second end 165 of the spring is positioned to engage the pawl member 174, and a fastener 178 is inserted through the aperture and into the second end 142 to secure the pawl member 174 to the pin 140. It is recognized that the components of the adjuster 100 could be assembled in any suitable order and this is just an example of how the adjuster 100 could be assembled.

Figure 7:
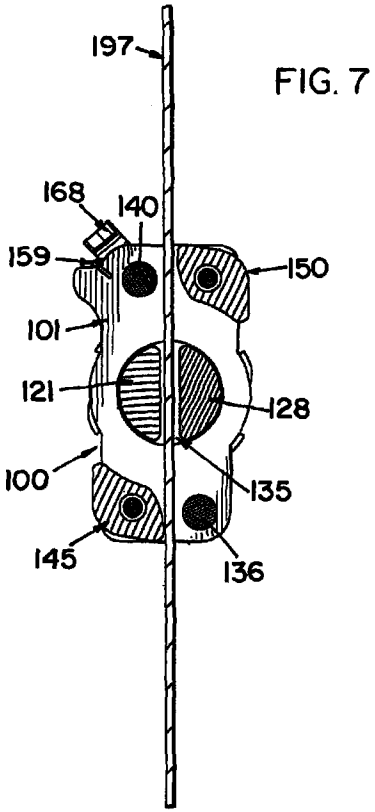
FIG. 7 is a cross-section view of the adjuster taken along the lines 7-7 shown in FIG. 6.
Figure 6:
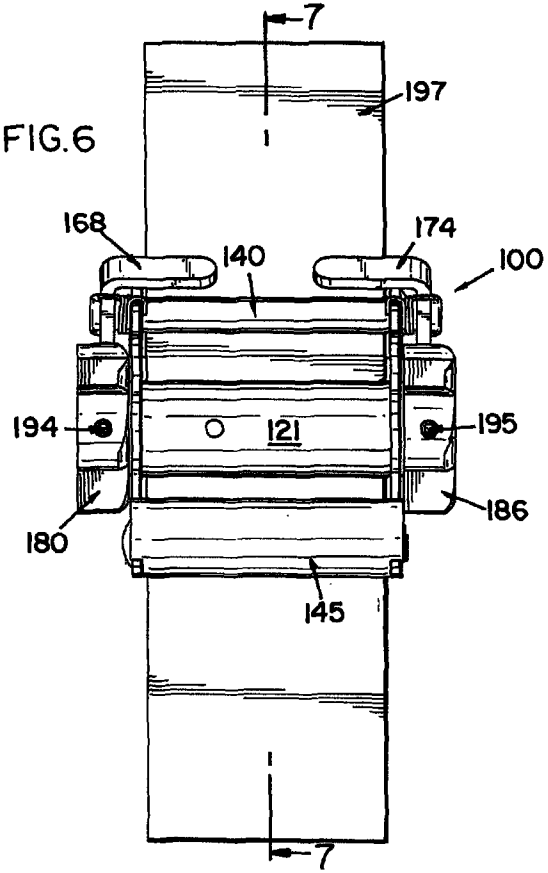
FIG. 6 is a front view of the adjuster shown in FIG. 1 connected to a strap in a positioning position.
Figure 9:
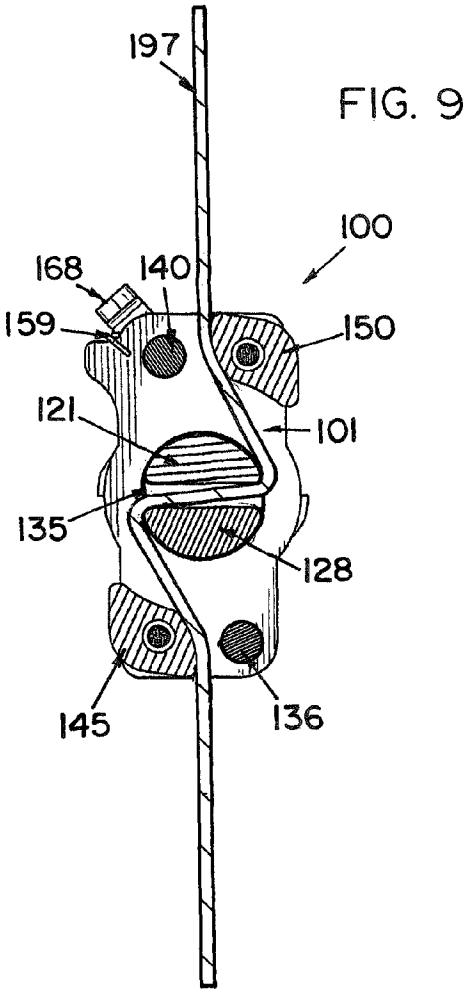
FIG. 9 is a cross-section view of the adjuster taken along the lines 9-9 shown in FIG. 8.
Figure 8:
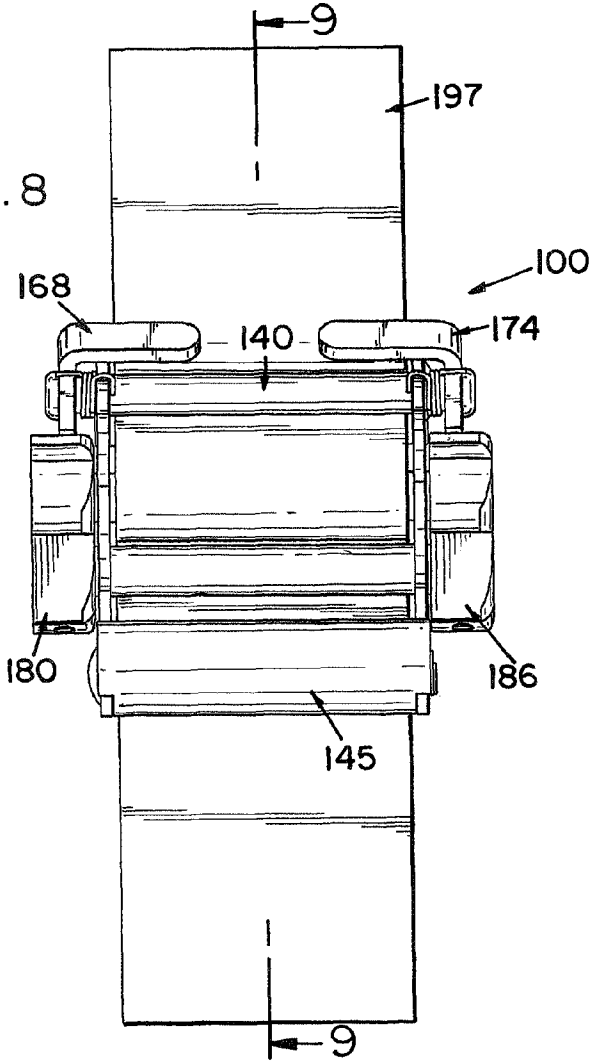
FIG. 8 is a front view of the adjuster shown in FIG. 1 connected to a strap in a partially wound position.
Figure 11:
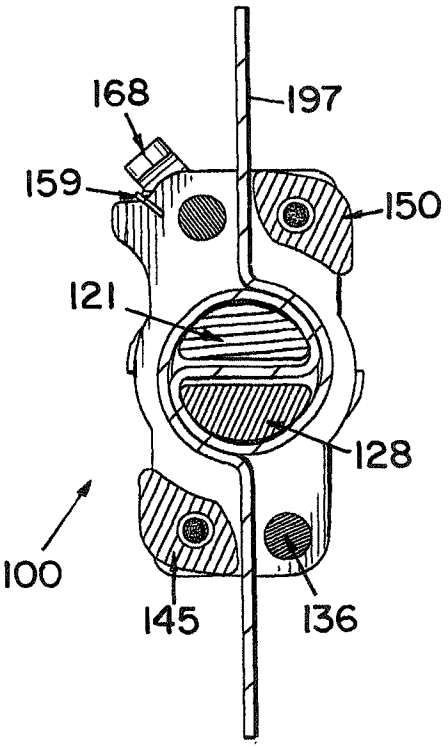
FIG. 11 is a cross-section view of the adjuster taken along the lines 11-11 shown in FIG. 10.
Figure 10:
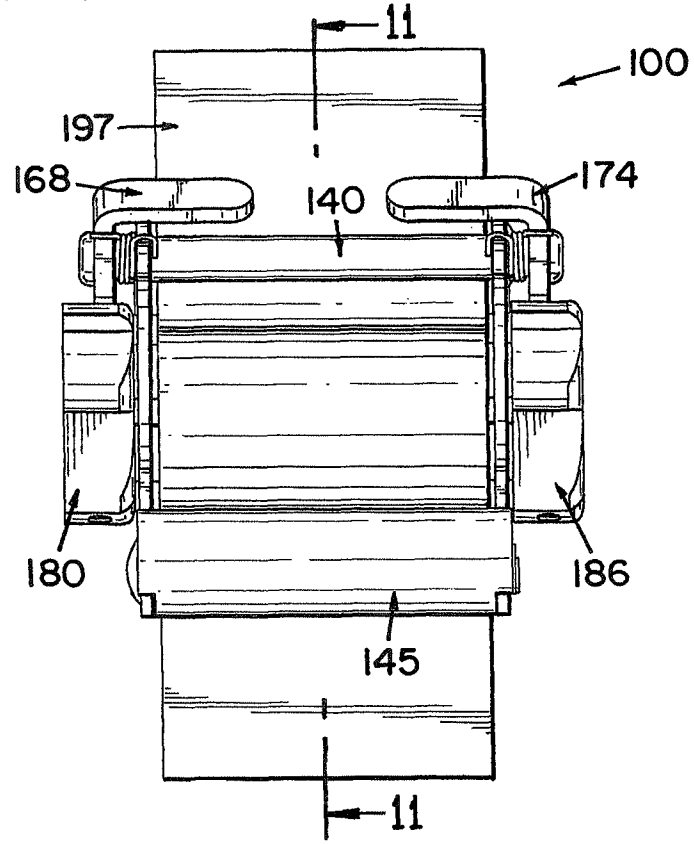
FIG. 10 is a front view of the adjuster shown in FIG. 1 connected to a strap in another partially wound position.
Figure 12:
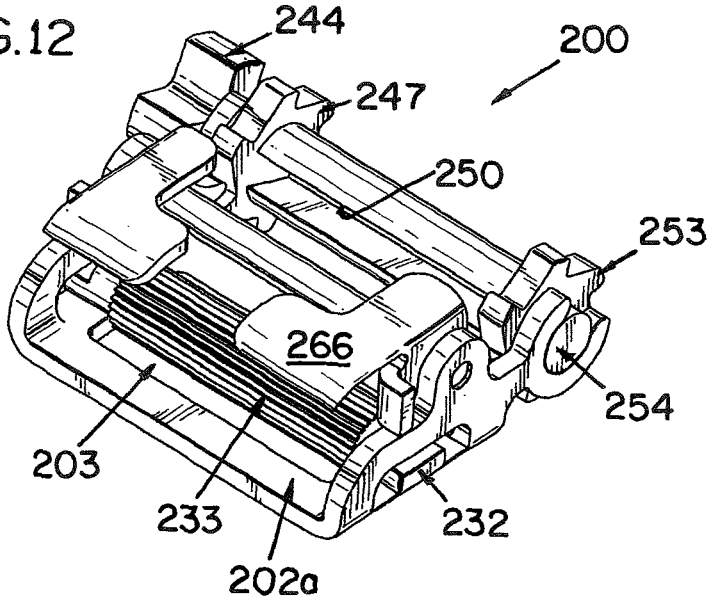
FIG. 12 is a bottom front perspective view of another embodiment adjuster constructed in accordance with the principles of the present invention.

In operation, the adjuster 100 could be moved along the length of the webbing 197 to a desired location when the adjuster 100 is in a positioning position, which is shown in FIGS. 6 and 7. One of the ratchet wheels 180 and 186 could be turned to take up any slack in the webbing 197 to obtain a desired fit. Because the ratchet wheels 180 and 186 are connected to the hub portions 121 and 128, turning one turns the other and the hub portions 121 and 128 rotate to wind the webbing 197 about the hub. The teeth provide a non-slip surface to assist in turning the ratchet wheels. The shape of the teeth allow rotation in one direction but prevent rotation in the opposite direction. The springs 158 and 163 bias the pawl members 168 and 174 to engage the teeth, and as the ratchet wheels turn, the pawl members 168 and 174 move to slide over the teeth and engage the adjacent teeth in the direction of rotation. A first partially wound position is shown in FIGS. 8 and 9, and a second partially wound position is shown in FIGS. 10 and 11.

To loosen the webbing 197, both pawl members 168 and 174 are pivoted to disengage the engaging portions 169 and 175 from the teeth, and this could be accomplished by applying a downward force on the release portions 170 and 176, which moves the engaging portions 169 and 175 upward away from the teeth. Then, either the webbing 197 can be pulled in opposite directions away from the adjuster 100 or the adjuster 100 can be pulled outward to unwind the webbing 197 from the hub or shaft.

An embodiment adjuster 200 is shown in FIGS. 12-18. Although the adjuster is being described in the orientation shown in FIG. 12, it should be understood that the adjuster should not be limited to this orientation.

The adjuster 200 includes a base 201 with an intermediate portion 202 interconnecting a first side 205 and a second side 215. The intermediate portion 202 is generally rectangular with an opening 203 between a front portion 202*a* and a rear portion 202*b*. The first side 205 extends upward proximate one side of the intermediate portion 202 and the second side 215 extends upward proximate an opposing side of the intermediate portion 202. The first side 205 includes a first end 206 and a second end 208 with an opening 207 between the ends 206 and 208. A first protrusion 209 extends upward from the first side 205 proximate the second end 208 and includes an aperture 210. A second protrusion 211 extends outward proximate the first protrusion 209 and includes a first arm 212 and a second arm 213 forming a notch 214 therebetween. The second side 215 includes a first end 216 and a second end 218 with an opening 217 between the ends 216 and 218. A first protrusion 219 extends upward from the second side 215 proximate the second end 218 and includes an aperture 220. A second protrusion 221 extends outward proximate the first protrusion and includes a first arm 222 and a second arm 223 forming a notch 224 therebetween.

A bar 230 includes a generally cylindrical intermediate portion 233 with a knurled surface 234 interconnecting a first end 231 and a second end 232, which are rectangular protrusions extending longitudinally outward from the intermediate portion 233. The intermediate portion 233 is configured and arranged to fit within the opening 203 of the base, and the ends 231 and 232 are configured and arranged to fit within the respective openings 207 and 217 in the sides 205 and 215 of the base 201. The bar 230 is preferably slidable within the base 201.

A hub or shaft portion 242 includes first and second portions 248 and 249, which form a slot 250 therebetween, interconnecting a first end 243 and a second end 251. The slot 250 is tapered so that one side is wider than the other side of the slot 250. The first end 243 includes connecting portion 245 interconnecting a knob 244 and a ratchet wheel 246. The knob 244 is a cross-shaped member as shown but could be any suitable knob, preferably with a non-slip type surface. The connecting portion 245 is configured and arranged to be received within the notch 214 by the arms 212 and 213. The ratchet wheel 246 includes teeth 247, and ends of the first and second portions 248 and 249 are operatively connected to the ratchet wheel 246 on the side opposite the connecting portion 245. The second end 251 includes a ratchet wheel 252 including teeth 253, and the opposing ends of the first and second portions 248 and 249 are operatively connected to the ratchet wheel 252. A protrusion 254 extends outward from the ratchet wheel 252 and is configured and arranged to be received within the notch 224 by the arms 222 and 223. The components of the hub portion 242 could be integral, molded as a single part, or separate parts operatively connected. The hub or shaft portion 242 could be made of plastic.

Figure 13:
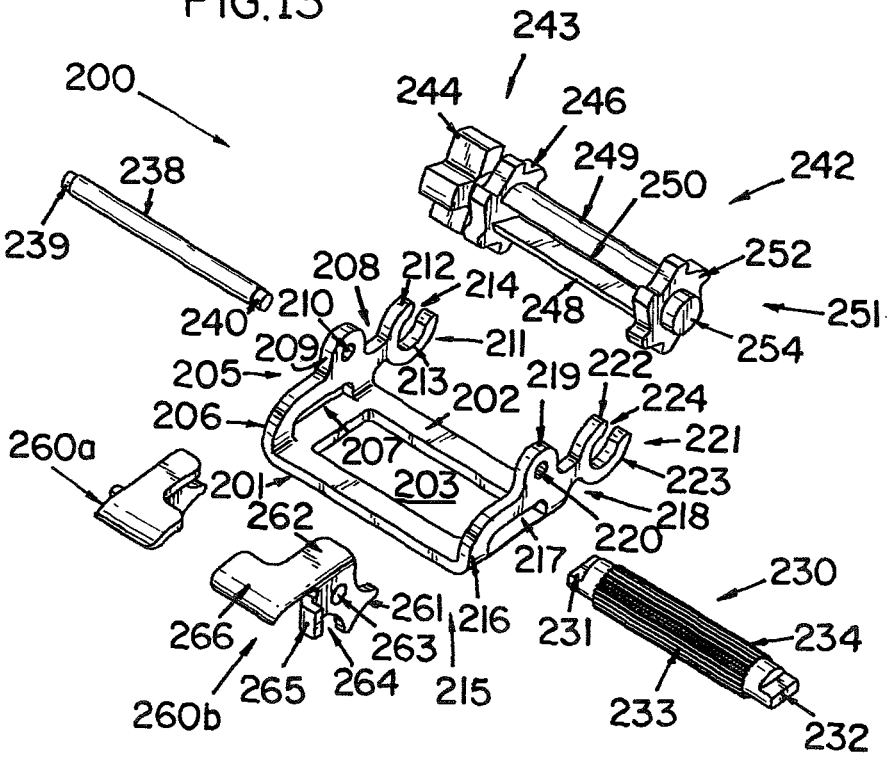
FIG. 13 is an exploded bottom front perspective view of the adjuster shown in FIG. 12.
Figure 16:
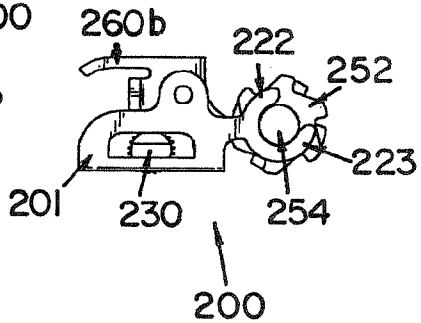
FIG. 16 is a second side view of the adjuster shown in FIG. 12.
Figure 14:
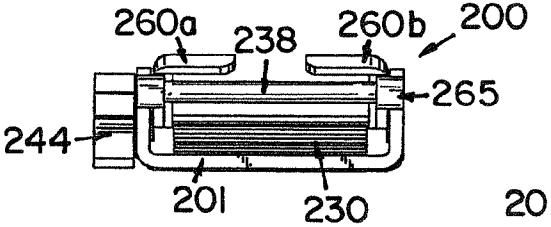
FIG. 14 is a bottom view of the adjuster shown in FIG. 12.
Figure 15:
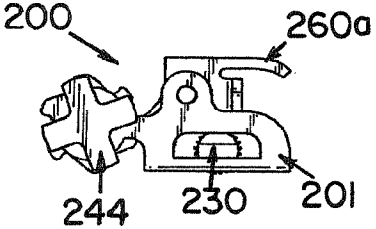
FIG. 15 is a first side view of the adjuster shown in FIG. 12.
Figure 17:
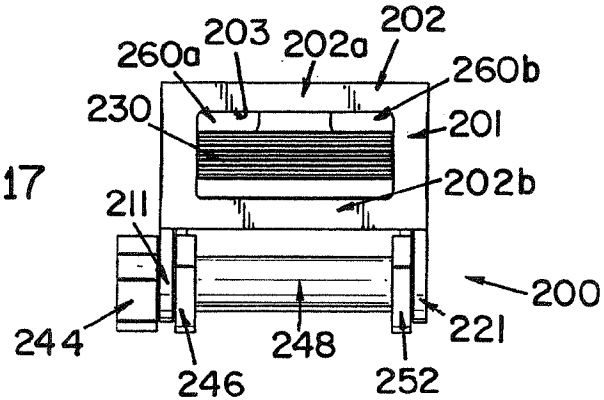
FIG. 17 is a rear view of the adjuster shown in FIG. 12.
Figure 18:
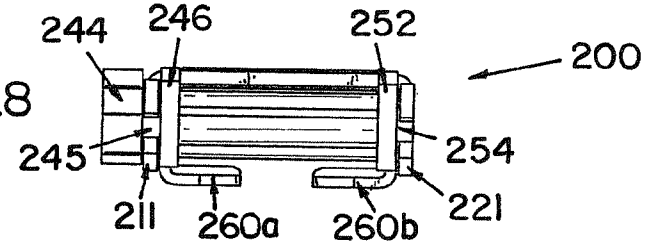
FIG. 18 is a top view of the adjuster shown in FIG. 12.

Pawls 260*a* and 260*b* are configured and arranged to releasably engage the respective ratchet wheels 246 and 252. As shown in FIG. 13, pawl 260*b* includes an engaging portion 261 configured and arranged to engage the ratchet wheel 252 proximate between two adjacent teeth 253, one of the teeth being configured and arranged to engage the engaging portion 261 and prevent rotation in one direction. An intermediate portion 262, which includes an aperture 263, a notch 264, and an extension portion 265, interconnects the engaging portion 261 and a release portion 266. The extension portion 265 extends outward from the intermediate portion 262 proximate the release portion 266, and the notch 264 is between the extension portion 265 and the engaging portion 261. Although not labeled, pawl 260*a* includes similar components as pawl 260*b*.

A pin 238 includes a first end 239 and a second end 240, which are smaller in diameter than an intermediate portion of the pin 238. The ends 239 and 240 of the pin 238 are inserted through the respective apertures of the pawls 260*a* and 260*b* and through bores of springs (not shown) before being inserted into the respective apertures 210 and 220 of the base 201. Portions of the ends 239 and 240 extending outward from the base 201 are clinched to form heads. One end of each spring engages the base 201 and the other end of each spring engages the respective pawl to place biasing forces on the pawls to bias the pawls in an engaging position to engage the ratchet wheels. The pawls' notches accommodate and position the bar 230 and also move the bar 230 when the pawls are pivoted. When the pawls engage the ratchet wheels, the bar 230 is positioned toward the rear portion 202*b*. When the pawls disengage the ratchet wheels, the bar 230 is positioned toward the front portion 202*a*. The springs bias the release portions of the pawls downward, and the pawls' extension portions contact the sides 205 and 215 to act as stops to prevent further downward movement of the pawls. The release portion 266 extends inward and provides a surface upon which a downward force can be exerted to overcome the biasing force of the springs and pivot the engaging portion 261 upward and away from the ratchet wheel 252 to release the ratchet wheels.

A webbing (not shown) includes an end, which is folded over approximately ¼ inch and sewn to itself using a "bar tac". Slot 250 is tapered so that the end of the webbing with the "bar tac" fits within the wider part of the slot but cannot be pulled through the narrower part of the slot. The webbing then goes under the base 201, through the opening 203 between the bar 230 and the front portion 202*a* of the base 201, around the bar 230, and then through the opening 203 between the bar 230 and the rear portion 202*b* proximate the other side of the base 201. The webbing is pinched between the bar 230 and the rear portion 202*b*, and friction keeps the webbing secured. The friction is sufficient to adequately keep the webbing in place should a load be applied to the webbing. An end of a second webbing (not shown) is inserted through the opening 203 between the bar 230 and the front portion 202*a* and then sewn to itself. Thus, the adjuster 200 is used to interconnect two webbings and adjust one of the webbings, the webbing connected to the hub portion 242.

In operation, to take up any slack or excess webbing, the knob 244 is rotated to wind a portion of the webbing around the portions 248 and 249, and as the knob 244 is rotated in the winding direction, the pawls 260 slide over the teeth to engage the ratchet wheels proximate the adjacent teeth. In the opposite direction, the pawls 260 are engaged by the teeth, which prevent the knob 244 from being rotated. As the webbing is being wound about the portions 248 and 249, the webbing slides through the intermediate portion 202 and around the bar 230. To loosen the webbing, both pawls 260 are disengaged from the ratchet wheels 246 and 252 by exerting an upward force on the release portions, which pivots the engaging portions downward and away from the teeth of the ratchet wheels. In addition, the pawls move the bar 230 toward the front portion 202*a* to allow the webbing to slide through the device. The knob 244 can then be rotated in the opposite, unwinding direction.

An embodiment adjuster 600, which is shown in FIGS. 50-53, is similar to adjuster 200. Therefore, only the relatively significant differences will be described. Although the adjuster is being described in the orientation shown in FIG. 51, it should be understood that the adjuster should not be limited to this orientation.

The adjuster's base includes a front portion 602*a* and a rear portion 602*b*, and sides 605 and 615 extend upward from the base similar to the adjuster 200. The bar 630 is similarly connected to the base. Proximate the second arm 613 of the first side, a protrusion 625 extends outward therefrom and includes an aperture 626, and proximate the second arm 623 of the second side, a protrusion 627 extends outward therefrom and includes an aperture 628.

A cover 675 is configured and arranged to connect to the base and includes a top 676, a hinge portion 677 through which a bore 677*a* extends, and a rear portion 678. The rear portion 678 includes a top 679 and a bottom 680 interconnected at the sides and forming a slot 681. The bore 677*a* is configured and arranged to receive the pin 638, and the pawls 660*a* and 660*b* are positioned on the pin 638 on each respective side of the cover 675. The ends of the pin 638 are then inserted into the apertures in the protrusions 609 and 619 to secure the cover 675 and the pawls 660*a* and 660*b* to the base. The pin 638 could also be a rivet. A fastener (not shown) such as a screw, a stud, or a rivet could be inserted through each of the apertures 626 and 628 in the base to secure the cover 675 to the base to prevent the cover 675 from opening.

A spring (not shown) is positioned about the pin 638 between the cover 675 and each of the pawls 660*a* and 660*b*, and one end is operatively connected to the cover 675 and the other end is operatively connected to the pawl to bias the pawl to engage the ratchet wheel. The end connected to the cover 675 is wrapped about the cylindrical portion forming the bore 677*a*, and the end connected to the pawl engages the pawl proximate the notch between the engaging portion and the release portion.

Figure 53:
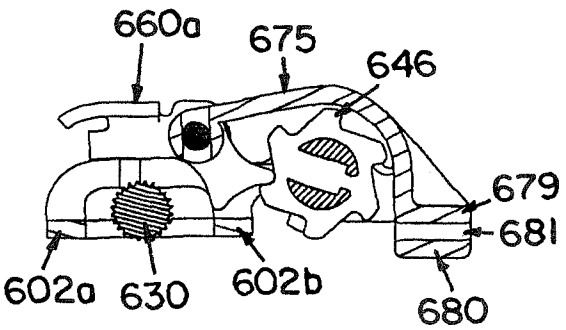
FIG. 53 is a cross section view of the adjuster taken along the lines 53-53 shown in FIG. 52.
Figure 52:
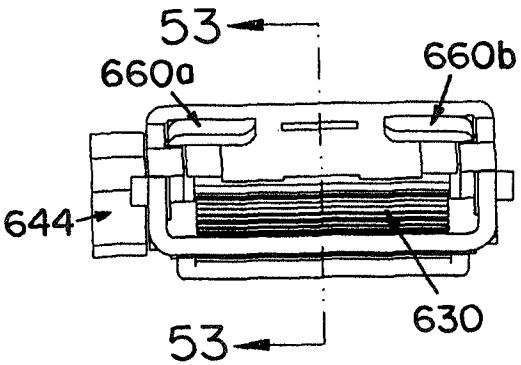
FIG. 52 is a front view of the adjuster shown in FIG. 50.

As shown in FIG. 53, the cover 675 conforms to the shape of the ratchet wheels 646 and 652 of the hub portion 642, and the knob 644 is positioned on the other side of the cover 675. The webbing (not shown) is similarly routed through the adjuster 600 as adjuster 200, but the webbing extends through the slot 681 of the cover 675. The tapered slot of the hub portion 642 is shown in FIG. 53. The cover 675 assists in keeping the webbing in place on the hub portion 642 and proximate the rear portion 678 of the cover 675.

An embodiment adjuster 300 is shown in FIGS. 19-23. Although the adjuster is being described in the orientation shown in FIGS. 19 and 20, it should be understood that the adjuster should not be limited to this orientation. The adjuster 300 includes plates 301 and 311 to which other components are operatively connected.

The plate 301 is generally rectangular-shaped and includes a first side 302 and a second side 306. The plate 301 also includes an aperture 303 proximate the top and the first side 302, an aperture 304 proximate the bottom and the first side 302, an aperture 307 proximate the top and the second side 306, an aperture 308 proximate the bottom and the second side 306, and a center aperture 305 between the side apertures.

The plate 311 is also generally rectangular-shaped and includes a first side 312 and a second side 316. The plate 311 also includes an aperture 313 proximate the top and the first side 312, an aperture 314 proximate the bottom and the first side 312, an aperture 317 proximate the top and the second side 316, an aperture 318 proximate the bottom and the second side 316, and a center aperture 315 between the side apertures. A ramp 319 is positioned proximate between the center aperture 315 and the apertures 313 and 314, and a ramp 320 is positioned proximate between the center aperture 315 and the apertures 317 and 318. The ramp 319 inclines from bottom to top, and ramp 320 inclines from top to bottom.

A shaft 322, which is generally cylindrical, includes an intermediate portion 324 interconnecting a first end 323 and a second end 326. The intermediate portion 324 includes a slot 325. The first and second ends 323 and 326 have smaller diameters than the intermediate portion 324. The second end 326 includes three portions with gradually smaller diameters and first and second shoulders 328 and 329 between the portions. Proximate the distal end of the second end 326 is a detent 327. Opposing sides of the second end 326 include flat portions 330. The first end 323 is configured and arranged to be inserted into the center aperture 305 of the plate 301, and the second end 326 is configured and arranged to be inserted into the center aperture 315 of the plate 311. The distal end of the second end 326 extends outward from the plate 311. The intermediate portion 324 of the shaft 322 is positioned between the plates 301 and 311.

Figure 20:
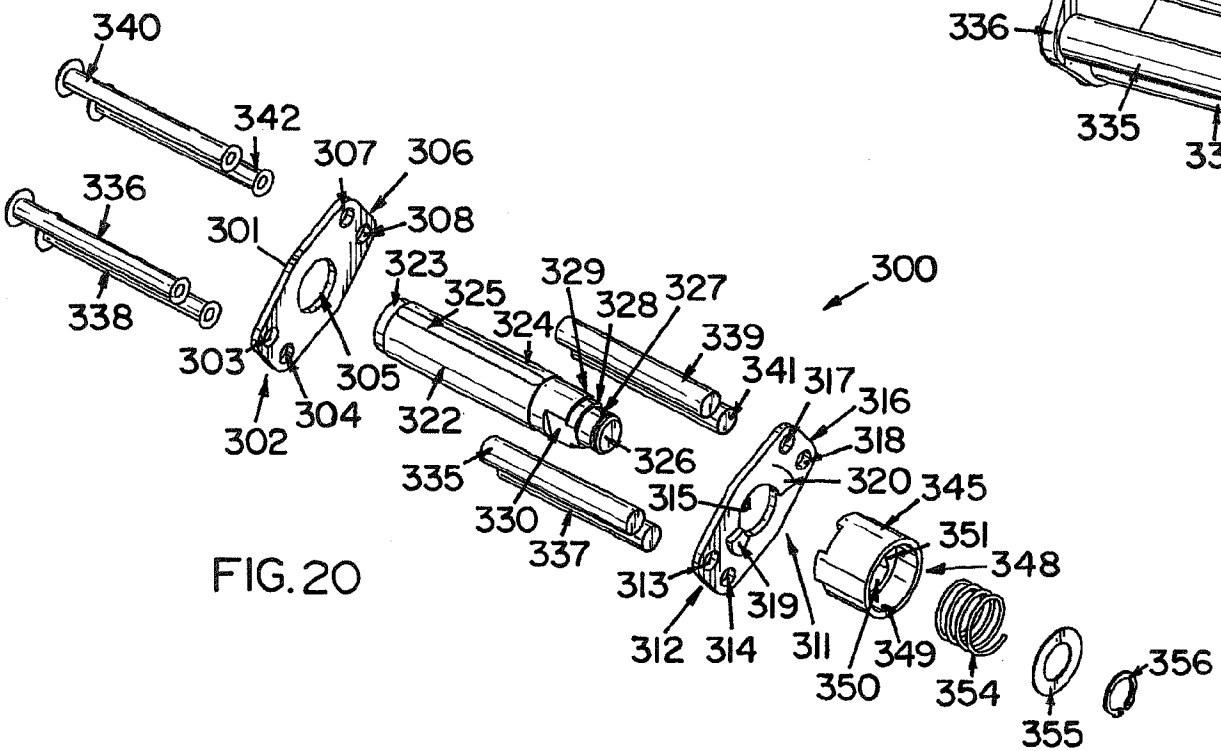
FIG. 20 is an exploded front perspective view of the adjuster shown in FIG. 19.

A spacer 335 having a longitudinal bore that corresponds with the apertures 303 and 313 is positioned between the plates 301 and 311, and a fastener 336 extends through the apertures 303 and 313 and the bore to connect the spacer 335 to the plates 301 and 311. A spacer 337 having a longitudinal bore that corresponds with the apertures 304 and 314 is positioned between the plates 301 and 311, and a fastener 338 extends through the apertures 304 and 314 and the bore to connect the spacer 337 to the plates 301 and 311. A spacer 339 having a longitudinal bore that corresponds with the apertures 307 and 317 is positioned between the plates 301 and 311, and a fastener 340 extends through the apertures 307 and 317 and the bore to connect the spacer 339 to the plates 301 and 311. A spacer 341 having a longitudinal bore that corresponds with the apertures 308 and 318 is positioned between the plates 301 and 311, and a fastener 342 extends through the apertures 308 and 318 and the bore to connect the spacer 341 to the plates 301 and 311. FIG. 20 shows the fasteners 336, 338, 340, and 342 already clinched to form heads to secure the spacers to the plates 301 and 311.

A knob 345 is generally cylindrical with a bore 350 extending longitudinally therethrough. The bore 350 includes opposing flat portions 351 corresponding with the flat portions 330 of the shaft 322 so that when the knob 345 is positioned about the second end 326, the knob 345 and the shaft 322 rotate together. A first end 346 of the knob 345 includes notches 347, preferably four spaced ninety degrees apart. Each notch 347 is configured and arranged to receive a portion of a ramp of the plate 311, two opposing notches receiving the ramps. A second end 348 includes a cavity 349 in fluid communication with the bore 350. A spring 354 is positioned within the cavity 349 and about the second end 326 of the shaft 322, and a washer 355 and a retaining ring 356, which engages the detent 327, secures the spring 354 to the shaft 322.

A webbing (not shown) extends through the slot 325 and between the spacers 335 and 337 and between the spacers 339 and 341. The spacers assist in reducing wear on the webbing. When the webbing is not wound about the shaft 322, the adjuster 300 is in a positioning position and can be slid along the length of the webbing to position the adjuster 300 in a desired location on the webbing.

Figure 19:
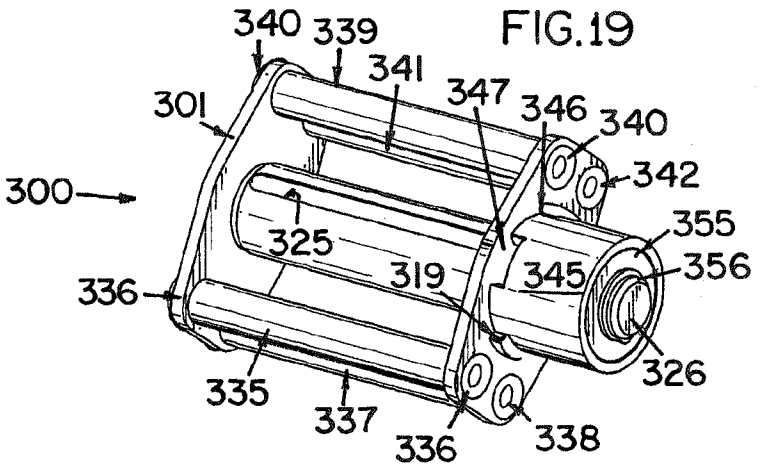
FIG. 19 is a front perspective view of another embodiment adjuster constructed in accordance with the principles of the present invention.
Figure 23:
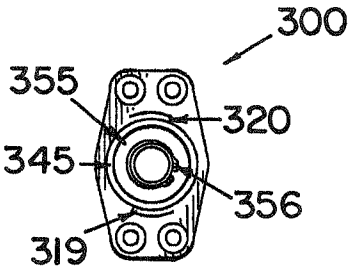
FIG. 23 is a second side view of the adjuster shown in FIG. 19.
Figure 21:
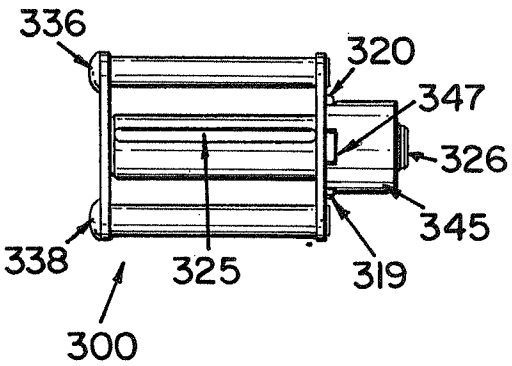
FIG. 21 is a top view of the adjuster shown in FIG. 19.
Figure 22:
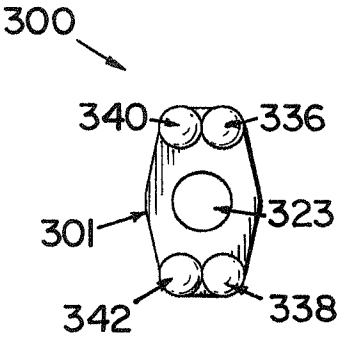
FIG. 22 is a first side view of the adjuster shown in FIG. 19.
Figure 24:
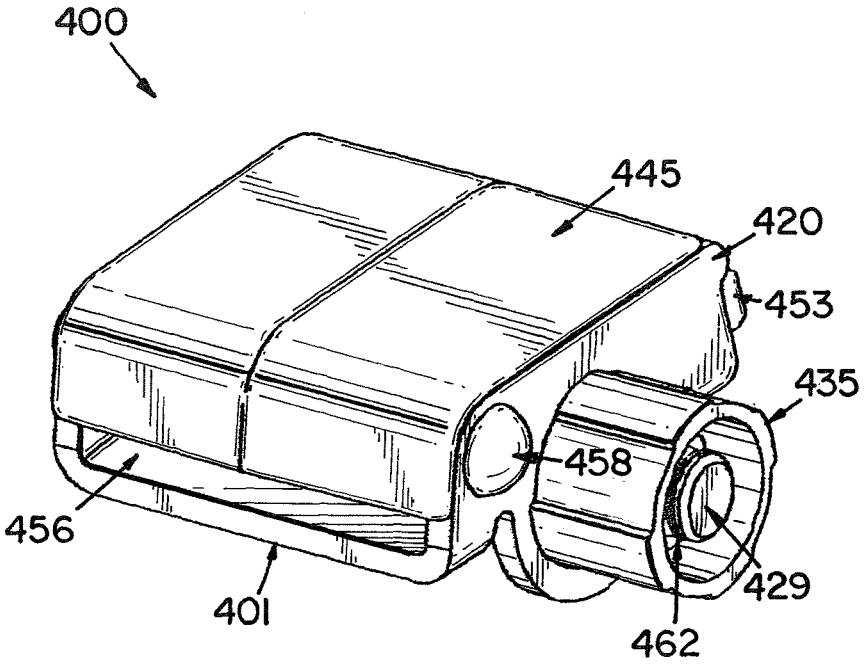
FIG. 24 is a bottom front perspective view of another embodiment adjuster constructed in accordance with the principles of the present invention.
Figure 25:
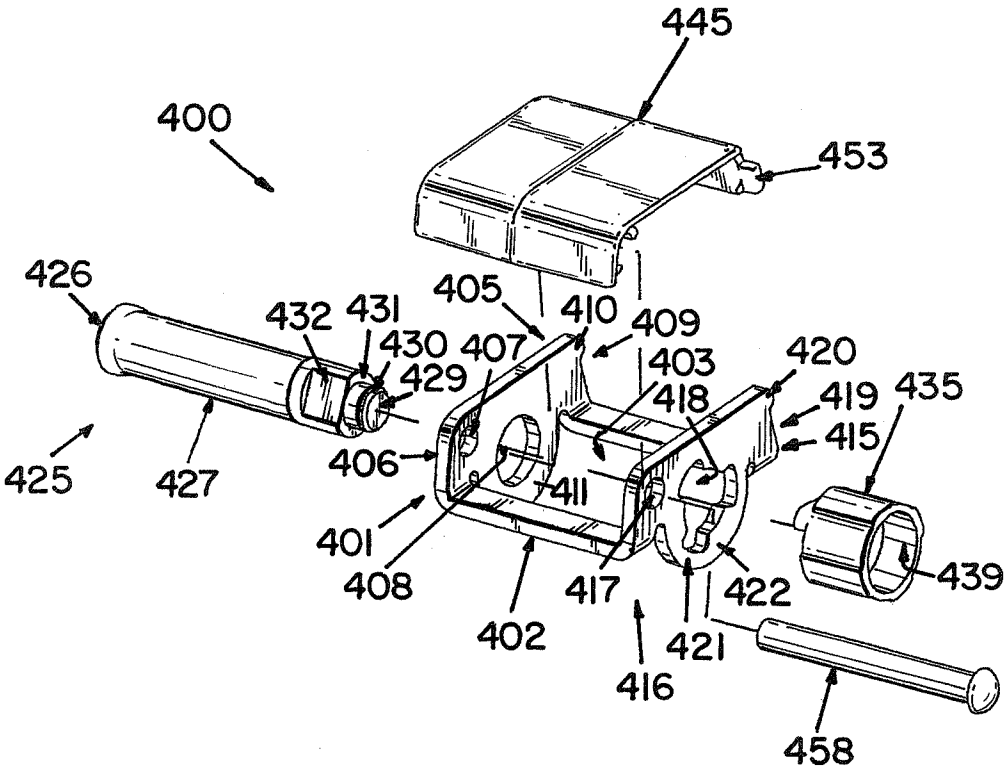
FIG. 25 is an exploded bottom front perspective view of the adjuster shown in FIG. 24.
Figure 32:
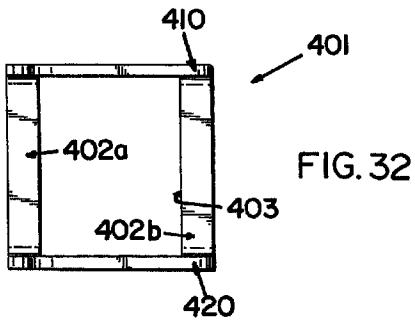
FIG. 32 is a front view of the base shown in FIG. 30.
Figure 30:
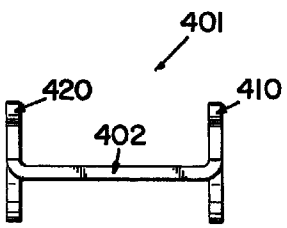
FIG. 30 is a bottom view of a base of the adjuster shown in FIG. 24.
Figure 33:
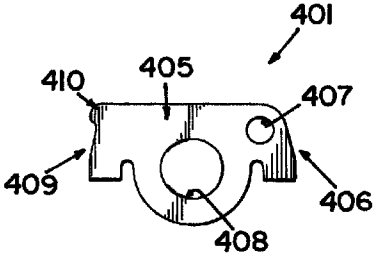
FIG. 33 is a second side view of the base shown in FIG. 30.
Figure 31:
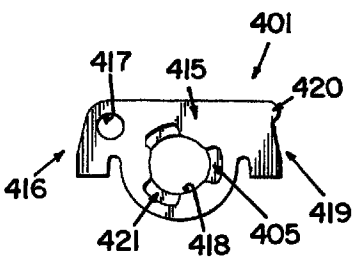
FIG. 31 is a first side view of the base shown in FIG. 30.
Figure 37:
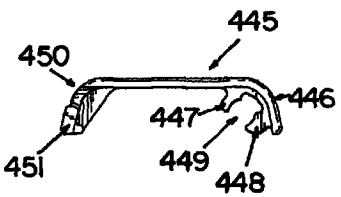
FIG. 37 is a second side view of the cover shown in FIG. 34.
Figure 34:
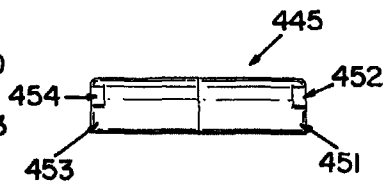
FIG. 34 is a top view of a cover of the adjuster shown in FIG. 24.
Figure 35:
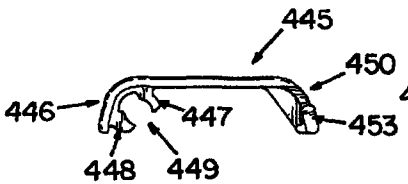
FIG. 35 is a first side view of the cover shown in FIG. 34.
Figure 36:
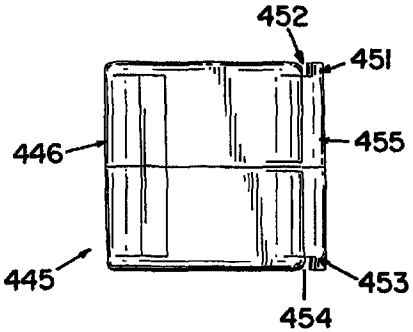
FIG. 36 is a front view of the cover shown in FIG. 34.
Figure 41:
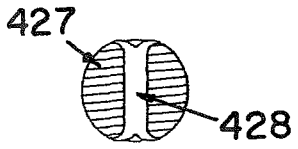
FIG. 41 is a cross-section view of the shaft taken along the lines 41-41 shown in FIG. 40.

In operation, the webbing is wound about the shaft 322 by simply turning the knob 345, which turns the shaft 322. The spring 354 places a biasing force on the knob 345, biasing the knob 345 toward the plate 311, and when the ramps 319 and 320 are engaged by the knob 345, the knob 345 cannot rotate in one direction and thus the shaft 322 cannot rotate in the one direction. As shown in FIGS. 19, 20, and 23, the one direction is a counter-clockwise direction. However, because the ramps 319 and 320 are inclined, the knob 345 can be rotated in the opposite direction and thus the shaft 322 can be rotated in the opposite direction. The opposite direction is a clockwise direction. To unwind the webbing from the shaft 322, the knob 345 is pulled outward away from the plate 311, compressing the spring, and the knob 345 disengages the ramps 319 and 320, which enables the knob 345 and the shaft 322 to be rotated in the counter-clockwise direction. When the knob 345 is released, the spring 354 biases the knob 345 toward the plate 311 to engage the ramps 319 and 320.

An embodiment adjuster 400 is shown in FIGS. 24-29. Although the adjuster is being described in the orientation shown in FIGS. 24 and 25, it should be understood that the adjuster should not be limited to this orientation.

A base 401, shown in FIGS. 30-33, includes an intermediate portion 402 interconnecting a first side 405 and a second side 415, which are preferably integral but could be separate components operatively connected together. The intermediate portion 402 includes an opening 403 between a front portion 402*a* and a rear portion 402*b* of the intermediate portion 402. The first side 405 includes a top portion extending upward from a side of the intermediate portion 402, proximate between the front and rear portions, having a front 406 and a rear 409 and includes a bottom portion 411 extending downward from the intermediate portion 402. The first side 405 also includes an aperture 407 proximate the front 406 and a protrusion 410 extending outward proximate the top of the rear 409. The bottom portion 411 is rounded and a bore 408 is positioned proximate the juncture of the top portion and the bottom portion 411.

The second side 415 includes a top portion extending upward from an opposing side of the intermediate portion 402, proximate between the front and rear portions, having a front 416 and a rear 419 and includes a bottom portion 422 extending downward from the intermediate portion 402. The first side 415 also includes an aperture 417 proximate the front 416 and a protrusion 420 extending outward proximate the top of the rear 419. The bottom portion 422 is rounded and a bore 418 is positioned proximate the juncture of the top portion and the bottom portion 422. The bore 418 includes notches 421, preferably three spaced approximately 120 degrees apart.

Figure 40:
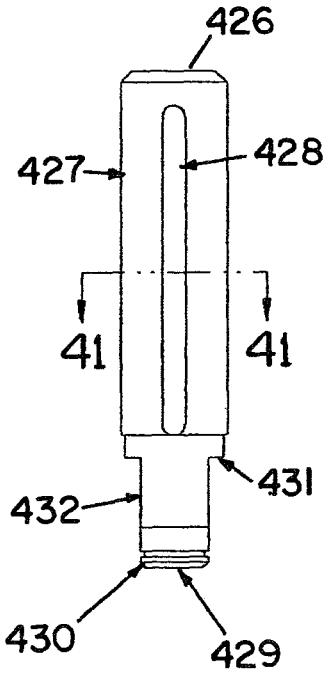
FIG. 40 is a front view of the shaft shown in FIG. 39.
Figure 42:
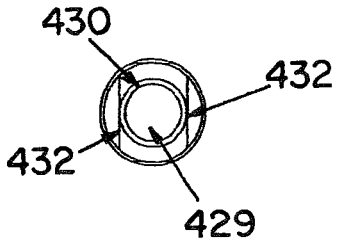
FIG. 42 is a side view of the shaft shown in FIG. 40.

A shaft 425, shown in FIGS. 39-42, includes an intermediate portion 427 interconnecting a first end 426 and a second end 429. The intermediate portion 427 includes a slot 428, which is preferably chamfered or radiused to reduce wear on the webbing. Because the slot 428 is chamfered or radiused, the first end 426 appears differently in FIGS. 39 and 40. The second end 429, as shown in FIGS. 39 and 40, includes a portion with a smaller diameter and a shoulder 431 between the two portions. Flat portions 432 are on opposing sides of the second end 429, and a detent is proximate the distal end of the second end 429.

Figure 43:
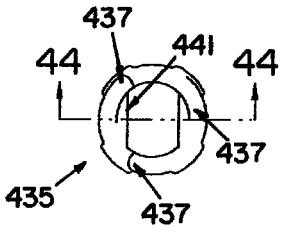
FIG. 43 is an inner side view of a knob of the adjuster shown in FIG. 24.
Figure 44:
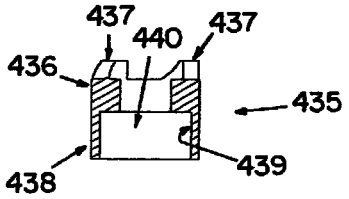
FIG. 44 is a cross-section view of the knob taken along the lines 44-44 shown in FIG. 43.
Figure 45:
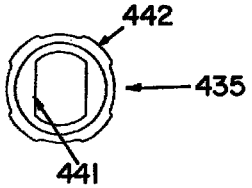
FIG. 45 is an outer side view of the knob shown in FIG. 43.

A knob 435, shown in FIGS. 43-45, is generally cylindrical with a bore 440 extending longitudinally therethrough and includes a first end 436 from which ramps 437 extend outward. Preferably there are three ramps 437 spaced approximately 120 degrees apart to correspond with the notches 421 of the bore 418. The ramps 437 incline in a clockwise direction about the bore 440. The second end 438 includes a cavity 439 with a larger diameter than the bore 440, which includes flat portions 441 on opposing sides of the bore 440 that correspond with the flat portions 432 of the shaft 425. The outer surface of the knob 435 preferably includes ribs 442 or any other suitable non-slip surface.

A cover 445, shown in FIGS. 34-37, includes a front 446 and a rear 450, which curve downward from an intermediate portion. First and second inner protrusions 447 and 448 extend along the front 446 and form a channel 449 therebetween. The rear 450 includes a flange 455 extending outward therefrom, and first and second protrusions 451 453 extend outward from opposing sides of the distal end of the flange 455 to form first and second notches 452 and 454, respectively.

The shaft 425 extends through the bores 408 and 418 so that the shaft's intermediate portion 427 is proximate the base's intermediate portion 402, the first side 405 receives the first end 426 within the bore 408, and the second side 415 receives the second end 429 within the bore 418. The second end 429 is inserted into the 439 of the knob 435, and the knob 435 is connected to the second end 429 with a washer 461 and a retaining ring 462. The retaining ring 462 is received in a receiving groove (detent) of a retaining portion 430 of the shaft 425 that is positioned proximate the second end 429 of the shaft 425. A spring 433 (shown in the embodiment in FIG. 46) is positioned between the shoulder 431 and the washer 461 about the second end 429, and the spring 433 places a biasing force on the knob 435, biasing knob 435 toward the second side 415 so the ramps 437 are positioned within the notches 421 to prevent rotation of the knob 435 and thus prevent rotation of the shaft 425.

The protrusions 410 and 420 of the base 401 fit within the notches 452 and 454 of the cover 445, and the apertures 407 and 417 of the base align with the channel 449 of the cover 445. A fastener 458, which is shown in FIG. 38, extends through the apertures 407 and 417 and the channel 449 to connect the cover 445 and the base 401. When the cover 445 and the base 401 are connected, a slot 456 is formed between the base 401 and the front 446 of the cover 445.

A webbing (not shown) includes an end, which is inserted through the slot 428, around one side of the intermediate portion 427, and then is secured to itself with stitching. Alternatively, the end of the webbing could be folded over approximately ¼ inch and sewn to itself using a "bar tac". Slot 428 could be chamfered or tapered so that the end of the webbing with the "bar tac" fits within the wider (outer) part of one side of the slot but cannot be pulled through the narrower (inner) part of the slot. The webbing extends through the slot 428 and through the slot 456 between the base 401 and the cover 445. An end of a second webbing (not shown) is inserted through the opening 403, positioned about the rear portion 402*b*, and then sewn to itself. Thus, the adjuster 400 is used to interconnect two webbings and adjust one of the webbings, the webbing connected to the shaft 425.

In operation, the webbing is wound about the shaft 425 by simply turning the knob 435, which turns the shaft 425. The ramps 437 are inclined so the knob 435 can only be rotated in the winding direction because the shoulders of the ramps 437 prevent the knob 435 from being rotated in the opposite, unwinding direction. The spring (not shown) places a biasing force on the knob 435, biasing the knob 435 toward the second side 415, and when the ramps 437 are engaged by the second side 415 within the notches 421, the knob 435 cannot rotate in the opposite, unwinding direction and thus the shaft 322 cannot rotate in the opposite, unwinding direction. To unwind the webbing from the shaft 425, the knob 435 is pulled outward away from the second side 415, compressing the spring, and the ramps 437 clear the notches 421, which enables the knob 435 and the shaft 425 to be rotated in the opposite, unwinding direction. When the knob 435 is released, the spring biases the knob 435 toward the second side 415 to engage the ramps 437.

Figure 46:
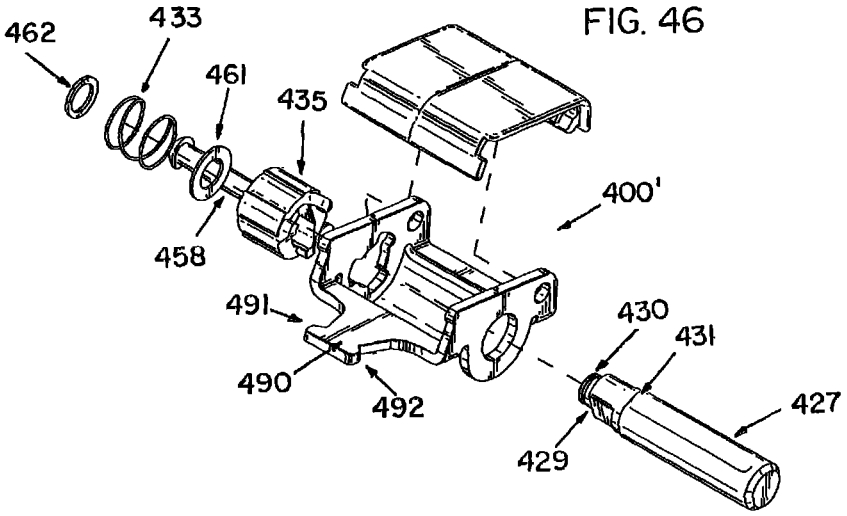
FIG. 46 is a rear perspective view of another embodiment adjuster including a male portion of a buckle constructed in accordance with the principles of the present invention.
Figure 47:
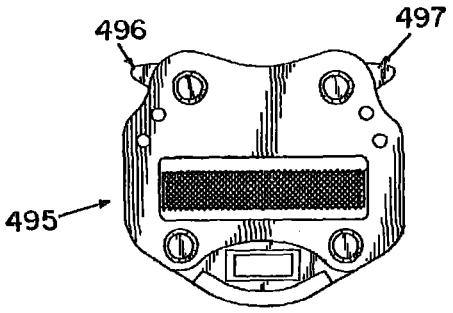
FIG. 47 is a front view of a female portion of a buckle for use with the adjuster shown in FIG. 46.

An embodiment adjuster 400' is shown in FIG. 46, and a female buckle portion 495 that could be used with the adjuster 400' is shown in FIG. 47. The adjuster 400' is similar to the adjuster 400 but includes a male buckle portion 490 extending outward from the rear portion of the base's intermediate portion. An example of a suitable female buckle portion that could be used is disclosed in U.S. Pat. No. 6,668,434. The male buckle portion 490 includes shoulders 491 and 492 configured and arranged to be engaged by the pawls 469 and 497 of the female buckle portion 495, which is well known in the art. Any suitable male buckle portions and female buckle portions could be used, and these portions could also be interchanged. In addition to quick-connect type buckles, pass-through type buckles or any other suitable types of buckles could also be used and one portion of these buckles could be connected to an adjuster to connect two straps.

Figure 48:
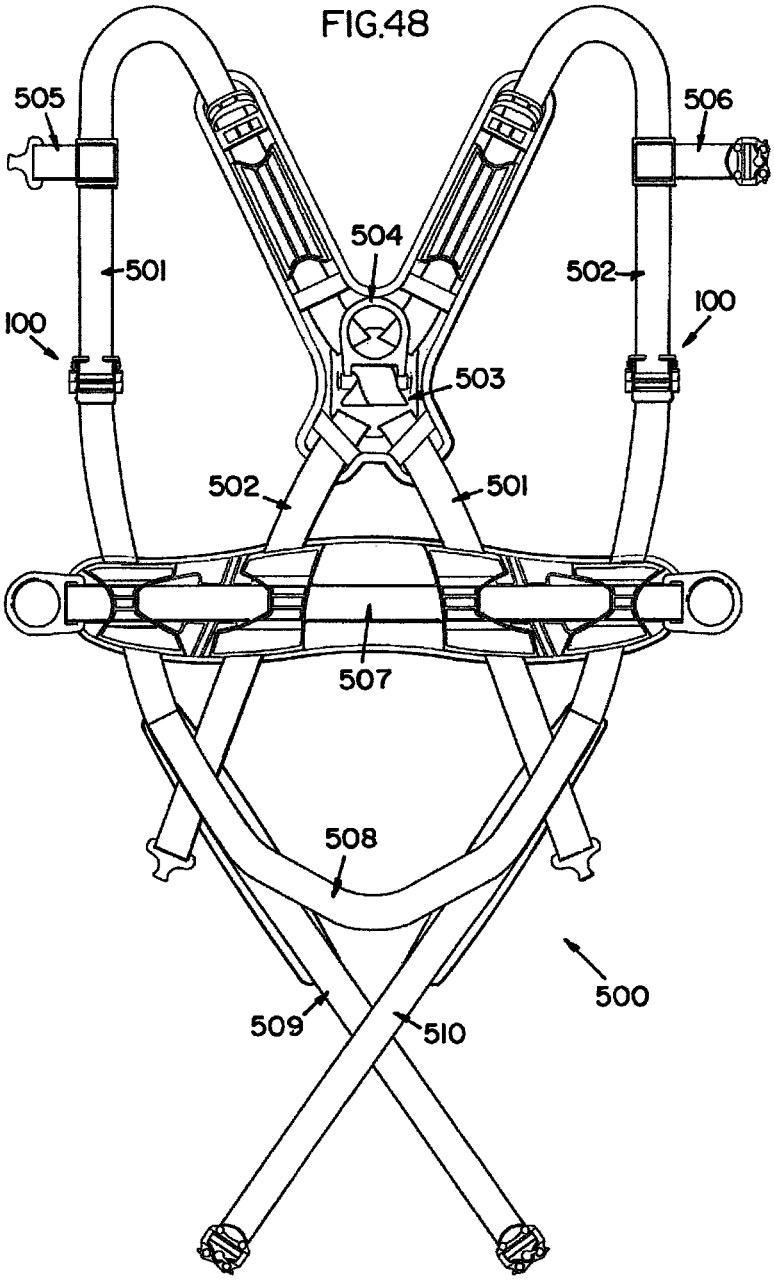
FIG. 48 is a rear view of a safety harness with adjusters.
Figure 51:
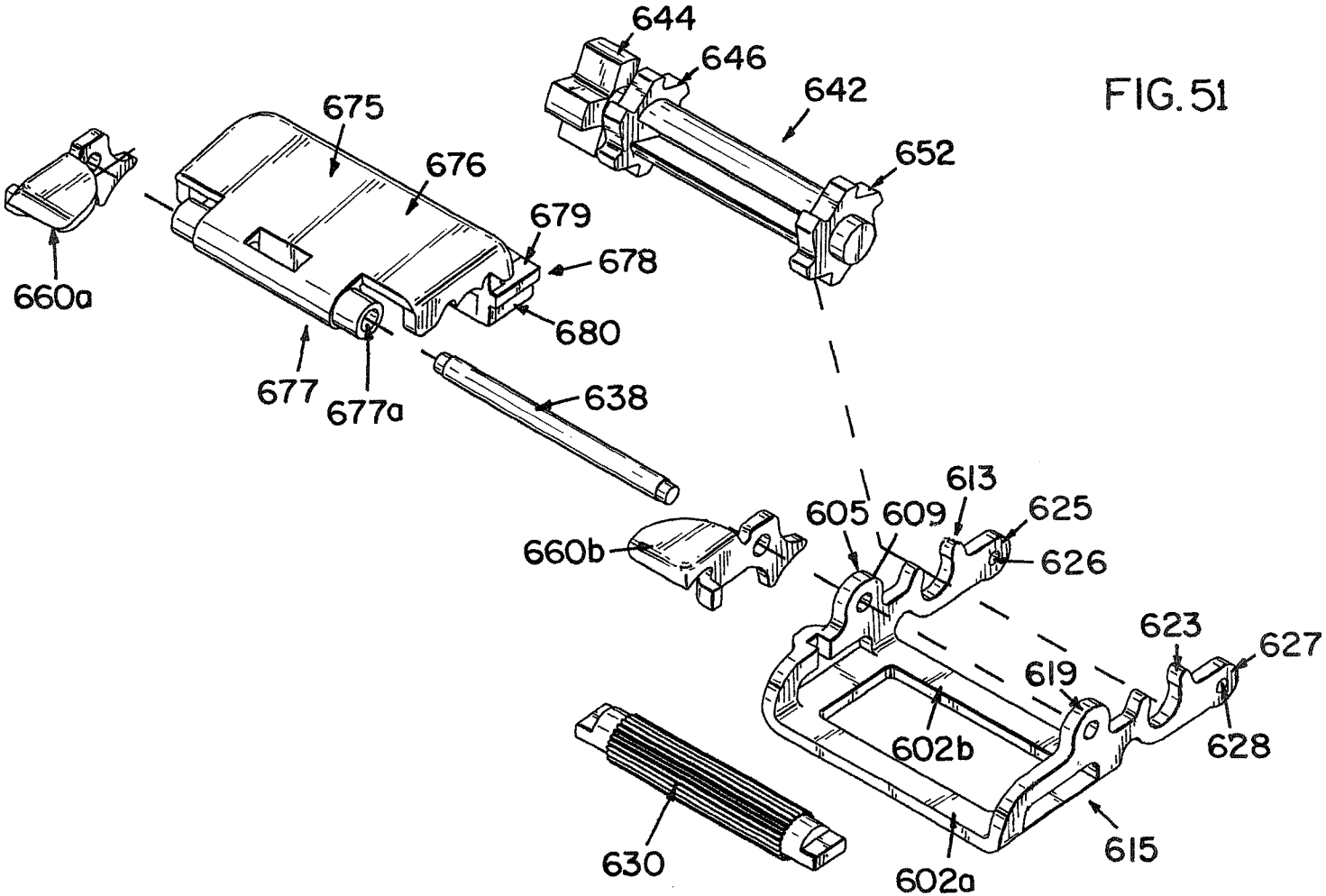
FIG. 51 is a front exploded perspective view of the adjuster shown in FIG. 50.

One possible use for the adjusters is shown in FIG. 48, which shows adjuster 100, but any suitable adjuster could be used. Although any suitable safety harness could be used, safety harness 500 is an example of a suitable safety harness. The safety harness straps could be made of webbing or any other suitable material. The safety harness 500 includes a first shoulder strap 501 and a second shoulder strap 502, which are routed through a dorsal pad 503, and a D-ring 504 is operatively connected to the straps 501 and 502 with the dorsal pad 503. Proximate the front of the safety harness 500, the shoulder straps 501 and 502 are interconnected with chest straps 505 and 506. A waist strap 507 connects the shoulder straps 501 and 502 proximate below the dorsal pad 503 and proximate below the chest straps 505 and 506, and a seat strap 508 is operatively connected to the shoulder straps 501 and 502 proximate the distal ends of the shoulder straps 501 and 502. Leg straps 509 and 510 are operatively connected proximate the junctures of the shoulder straps 501 and 502 and the seat strap 508.

The adjuster 100 is operatively connected to the shoulder straps 501 and 502 between the chest straps 505 and 506 and the waist strap 507, and the adjuster 100 is used to adjust the lengths of the shoulder straps 501 and 502 by winding any excess webbing about the hub or shaft portions. An adjuster similar to adjusters 100 and 300 could be used to adjust the lengths of the shoulder straps 501 and 502.

Examples of other possible uses, which should not considered exhaustive, for adjusters with safety harnesses are shown in FIG. 49. Although any suitable safety harness could be used, safety harness 600 is an example of a suitable safety harness. The safety harness 600 includes a first shoulder strap 601 and a second shoulder strap 602, which are interconnected with chest straps 605 and 606. An optional waist strap, with end portions 607*a* and 607*b*, connects the shoulder straps 601 and 602 proximate below the chest straps 605 and 606, and a seat strap 608 is operatively connected to the shoulder straps 601 and 602 proximate the distal ends of the shoulder straps 601 and 602. Leg straps, with end portions 609*a* and 609*b* and straps 610*a* and 610*b*, are operatively connected proximate the junctures of the shoulder straps 601 and 602 and the seat strap 608.

The various locations of where adjusters could be used on safety harness 600 are indicted by blocks in FIG. 49. Adjuster A1 interconnects the chest straps 605 and 606, and adjuster A1 could be one of the adjusters 200, 400, 400', and 600. Alternatively, if the chest strap were a single strap rather than two straps, one of the adjusters 100 and 300 could be used.

Adjusters A2 and A3 are operatively connected to the shoulder straps 601 and 602, respectively, and adjusters A2 and A3 could be one of the adjusters 100 and 300. Alternatively, if the shoulder straps were two straps each rather than a single strap each, one of the adjusters 200, 400, 400', and 600 could be used. In addition, if the adjusters A2 and A3 were adjusters 400 or other suitable adjusters, buckles could be used in the locations of the adjusters A4 and A5 to connect the shoulder strap portions to the ends of the seat strap 608.

Adjusters A4 and A5 interconnect the shoulder straps 601 and 602 and the ends of the seat strap 608, and adjusters A4 and A5 could be one of the adjusters 200, 400, 400', and 600.

Adjuster A6 interconnects the end portions 607*a* and 607*b* of the waist strap, and adjuster A6 could be one of the adjusters 200, 400, 400', and 600.

Adjusters A7 and A8 interconnect the end portions 609*a* and 609*b* and the end portions 610*a* and 610*b*, respectively, of the leg straps, and adjusters A7 and A8 could be one of the adjusters 200, 400, 400', and 600.

Because the adjusters wind excess webbing material about the hub or the shaft, there are not any end portions left hanging from the safety harness. Thus, the risk of the safety harness getting caught on something is reduced.

In addition, once the straps are adjusted, the straps should not have to be readjusted because the adjusters reduce the likelihood that the straps will become loose during use.

Several embodiments have been described as examples, and the various features could be interchanged among the embodiments.

The above specification, examples, and data provide a complete description of the manufacture and use of the composition of embodiments of the invention. Since many embodiments of the invention can be made without departing from the spirit and scope of the invention, the invention resides in the claims hereinafter appended.

I claim:

1. An adjustment system for adjusting a length of at least one strap of a fall protection safety harness, the adjustment system comprising:

the fall protection safety harness configured to arrest a user wearing said safety harness during a fall, the safety harness including the at least one strap being selected from the group consisting of: at least one shoulder strap, at least one chest strap, at least one waist strap, at least one seat strap, and at least one leg strap; and an adjuster including:

a base;

a shaft rotatably operatively connected to the base, the shaft defining a slot configured and arranged to receive the at least one strap of the safety harness to adjust the length of the at least one strap while the user is wearing the safety harness;

a locking mechanism interconnecting the base and the shaft, the locking mechanism being capable of moving between an engaged position and a disengaged position, the locking mechanism including a knob operatively connected to an end of the shaft, the knob and the shaft configured to rotate in a first direction and an opposite second direction, a spring operatively connected to the end of the shaft and to the knob to bias the knob toward the base into the engaged position, one of the base and the knob having at least one inclined ramp and the other of the base and the knob having at least one notch, wherein the at least one notch receives the at least one inclined ramp when in the engaged position, and wherein the shaft is rotatable relative to the base in the first direction while prevented from rotation in the second direction when the at least one ramp is positioned in the at least one notch in the engaged position, and wherein the shaft is rotatable relative to the base in the first and second directions when the locking mechanism in the disengaged position, wherein the locking mechanism is in the disengaged position when the at least one ramp is removed from the at least one notch as a direct result of the knob having been pulled axially away from the base and against the bias of the spring.

2. The adjustment system of claim 1, wherein the shaft is configured and arranged to receive the at least one strap in a desired position along the length of the at least one strap such that rotation of the shaft in the first direction takes slack out of the at least one strap by winding the at least one strap around the shaft about the desired position along the length of the at least one strap.

3. The adjustment system of claim 1, wherein the base includes a male buckle portion.

4. An adjustment system for adjusting a length of at least one strap of a fall protection safety harness, the adjustment system comprising:

the fall protection safety harness configured to arrest a user wearing said safety harness during a fall, the safety harness including the at least one strap being selected from the group consisting of: at least one shoulder strap, at least one chest strap, at least one waist strap, at least one seat strap, and at least one leg strap; and an adjuster including:

a base;

a shaft rotatably operatively connected to the base, the shaft defining a slot configured and arranged to receive the at least one strap of the safety harness to adjust the length of the at least one strap while the user is wearing the safety harness;

a cover;

a fastener coupling the cover to the base, the cover and base forming an opening to a strap passage slot that leads to the shaft, the at least one strap of the safety harness passing through the opening to the slot of the shaft; and a locking mechanism interconnecting the base and the shaft, the locking mechanism being capable of moving between an engaged position and a disengaged position, the locking mechanism including, a knob operatively connected to an end of the shaft, the knob and shaft configured to rotate in a first direction and an opposite second direction, a spring operatively connected to the end of the shaft and to the knob to bias the knob toward the base into the engaged position, one of the base and the knob having at least one inclined ramp and the other of the base and the knob having at least one notch, wherein the at least one notch receives the at least one inclined ramp when in the engaged position, and wherein the shaft is rotatable in the first direction while prevented from rotation in the second direction when the at least one ramp is positioned in the at least one notch in the engaged position, and wherein the shaft is rotatable in the first and second directions when the locking mechanism in the disengaged position, wherein the locking mechanism is in the disengaged position when the at least one ramp is removed from the at least one notch as a direct result of the knob having been pulled axially away from the base and against the bias of the spring.

5. The adjustment system of claim 4, wherein the slot of the shaft is tapered to receive an end of the at least one strap.

6. The adjustment system of claim 4, wherein the base includes the ramp and the knob includes the notch.

7. The adjustment system of claim 4, wherein the base includes the notch and the knob includes the ramp.

8. The adjustment system of claim 4, further wherein:

the base having a pair of spaced apertures;

the cover having a channel; and the fastener extending through the pair of spaced apertures in the base and the channel of the cover to at least in part couple the cover to the base.

9. The adjustment system of claim 4, wherein the shaft is configured and arranged to slide along the length of the at least one strap before the at least one strap is wound about the shaft.

10. The adjustment system of claim 4, wherein the base is configured and arranged to interconnect the at least one strap and a second strap, the shaft operatively connected to the at least one strap.

11. The adjustment system of claim 10, wherein the base includes a male buckle portion configured and arranged to be operatively connected to a female buckle portion to which the second strap is connected.

12. The adjustment system of claim 4, wherein the shaft is configured and arranged to receive the at least one strap in a desired position.

* * * * *